US009598756B2

(12) United States Patent
Oohashi et al.

(10) Patent No.: US 9,598,756 B2
(45) Date of Patent: Mar. 21, 2017

(54) METHOD FOR PRODUCING HOT DIP PLATED STEEL SHEET AND APPARATUS FOR HOT DIP PLATING

(75) Inventors: Tooru Oohashi, Tokyo (JP); Masato Kageyama, Tokyo (JP); Satoshi Uchida, Tokyo (JP); Katsuhiro Hamaguchi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 951 days.

(21) Appl. No.: 12/998,218

(22) PCT Filed: Oct. 1, 2009

(86) PCT No.: PCT/JP2009/005089

§ 371 (c)(1),
(2), (4) Date: Mar. 25, 2011

(87) PCT Pub. No.: WO2010/038472

PCT Pub. Date: Apr. 8, 2010

(65) Prior Publication Data

US 2011/0177253 A1 Jul. 21, 2011

(30) Foreign Application Priority Data

Oct. 1, 2008 (JP) ..... 2008-256208

(51) Int. Cl.
*B05D 1/18* (2006.01)
*C23C 2/18* (2006.01)
(Continued)

(52) U.S. Cl.
CPC ..... *C23C 2/18* (2013.01); *C23C 2/06* (2013.01); *C23C 2/12* (2013.01); *C23C 2/20* (2013.01)

(58) Field of Classification Search
CPC ..... B05C 13/02
(Continued)

(56) References Cited

U.S. PATENT DOCUMENTS 2,526,731 A * 10/1950 Coburn ..... 427/224
4,369,211 A * 1/1983 Nitto et al. ..... 427/349
(Continued)

FOREIGN PATENT DOCUMENTS

GB 2 073 785 A 10/1981
JP 53-052549 A 5/1978
(Continued)

OTHER PUBLICATIONS

International Search Report dated Oct. 27, 2009 issued in corresponding PCT Application No. PCT/JP2009/005089.
(Continued)

*Primary Examiner* — Alexander Weddle
(74) *Attorney, Agent, or Firm* — Birch, Stewart, Kolasch, & Birch, LLP

(57) ABSTRACT

A method for producing a hot dip plated steel sheet, the method controlling a coating weight by injecting a gas toward a surface of a steel sheet from a time when the steel sheet continuously immersed into a plating bath is pulled up from the plating bath to a time when plating metal adhered onto the surface of the steel sheet is solidified, the method includes: setting an oxygen concentration of a bath surface of the plating bath to be more than or equal to 0.05 vol % and less than or equal to 21 vol % when the gas is injected toward the surface of the steel sheet; and setting an oxygen concentration in a space of an end of the steel sheet at a position where the gas collides with the steel sheet pulled up from the plating bath to be more than or equal to 0.05 vol % and less than or equal to 3 vol % when the gas is injected toward the surface of the steel sheet.

19 Claims, 15 Drawing Sheets

(51) Int. Cl.
*C23C 2/06* (2006.01)
*C23C 2/12* (2006.01)
*C23C 2/20* (2006.01)

(58) Field of Classification Search
USPC ..... 427/331, 349; 118/63
See application file for complete search history.

(56) References Cited

U.S. PATENT DOCUMENTS

| | | | | |
|---|---|---|---|---|
| 5,201,132 | A * | 4/1993 | Jacob | 34/393 |
| 6,235,410 | B1 * | 5/2001 | Komatsu et al. | 428/659 |
| 6,752,870 | B1 * | 6/2004 | Tanokuchi et al. | 118/63 |
| 2005/0247262 | A1 * | 11/2005 | Yoshikawa et al. | 118/101 |
| 2009/0208665 | A1 * | 8/2009 | Eriksson et al. | 427/547 |
| 2011/0177253 | A1 | 7/2011 | Oohashi et al. | |

FOREIGN PATENT DOCUMENTS

| | | | |
|---|---|---|---|
| JP | 53052549 | A * | 5/1978 |
| JP | 53-095831 | | 8/1978 |
| JP | 55-110770 | | 8/1980 |
| JP | 56-163252 | A | 12/1981 |
| JP | 57-192953 | U | 12/1982 |
| JP | 61-34504 | | 8/1986 |
| JP | 62-030864 | | 2/1987 |
| JP | 63-317655 | A | 12/1988 |
| JP | 01-177350 | | 7/1989 |
| JP | 02-285060 | | 11/1990 |
| JP | 04-285148 | | 10/1992 |
| JP | 11-140615 | | 5/1999 |
| JP | 2003-277908 | | 10/2003 |
| JP | 2007-063647 | | 3/2007 |
| JP | 4988045 | | 8/2012 |

OTHER PUBLICATIONS

Taiwanese Notice of Allowance dated Apr. 1, 2013, issued in corresponding Taiwanese Application No. 098133398, with an English translation of the Search Report only.

Office Action in Japanese Patent Application No. 2010-531757 dated Oct. 25, 2011 (with English translation).

Office Action dated Jul. 4, 2014 issued in related Vietnamese Application No. 1-2011-00823 [with English Translation].

* cited by examiner

METHOD FOR PRODUCING HOT DIP PLATED STEEL SHEET AND APPARATUS FOR HOT DIP PLATING

BACKGROUND OF THE INVENTION

Field of the Invention

The present invention relates to a method for producing a hot dip plated steel sheet and an apparatus for hot dip plating used in the method.

The present application is a national stage application of International Application No. PCT/JP2009/005089, filed Oct. 1, 2009, which claims priority to Japanese Patent Application No. 2008-256208, filed on Oct. 1, 2008, the content of which is incorporated herein by reference in its entirety.

Description of Related Art

In a process of producing a hot dip plated steel sheet, a coating weight is controlled by injecting a gas from a wiping nozzle toward a steel sheet during a time when the moving steel sheet (steel strip) is continuously immersed into a plating bath, the steel sheet is pulled up from the plating bath, and then plating metal coated onto a surface of the steel sheet is solidified. At this time, oxide films (dross) are formed on the plated surface of the steel sheet due to the oxidization of the molten plating metal, which degrades the appearance of a product.

In order to prevent the oxidization of the plating metal, there is proposed a technique in which an entire region from a bath surface of the plating bath to a gas injection position of the wiping nozzle is covered with a seal box and an inert gas is introduced into the seal box so as to decrease the oxygen concentration of the entire atmosphere in the seal box (for example, see Japanese Unexamined Patent Application, First Publication No. H11-140615, No. S62-30864, No. H04-285148, and Japanese Examined Patent Application, Second Publication No. S61-34504). According to this technique, since it is possible to decrease the oxygen concentration to less than that of an ambient atmosphere during a time when the steel sheet is pulled up from the plating bath and the molten plating metal is solidified, it is possible to prevent the oxidization of the plating metal.

However, in the technique of covering the entire region from the bath surface of the plating bath to the gas injection position of the wiping nozzle by using the seal box as in the techniques disclosed in Japanese Unexamined Patent Application, First Publication No. H11-140615, No. S62-30864, No. H04-285148, and Japanese Examined Patent Application, Second Publication No. S61-34504, it is possible to obtain the advantage of suppressing the formation of the oxide films, but it is difficult to visually recognize the gas injection position for controlling the coating weight which is important for the hot dip plating operation. In addition, it is difficult to remove surface oxide films formed on the surface of the plating bath or to maintain the wiping nozzle. For this reason, there is a problem in that the operation is inconvenient. In addition, in the case where a surface of a plating liquid is not covered with a certain amount of oxide films, zinc fume is generated from the surface. When metallic zinc is adhered to an apparatus such as the wiping nozzle due to the zinc fume, it is not possible to normally perform the wiping operation. For this reason, there is a problem in that the quality of the product is degraded. Accordingly, when the techniques are used in a practical application, there is a problem in that the operability and the plating quality are degraded.

The present invention is contrived in consideration of such circumstances, and an object of the present invention is to provide a method for producing a hot dip plated steel sheet and an apparatus for hot dip plating used in the method capable of suppressing the formation of the oxide films on the surface of the plated steel sheet during controlling the coating weight and eliminating the disadvantages in the operation and quality.

SUMMARY OF THE INVENTION

The inventors found that the oxide film formation position of the surface of the plated steel sheet is the gas injection position of steel sheet edge (end of the steel sheet) as a result of the repeated studies in order to solve the problems. Thus, the inventors decreased the oxygen concentration in the seal box by installing a seal box smaller than seal boxes of the conventional techniques so as to cover at least the steel sheet edge in the gas injection position where the coating weight is controlled. The inventors found that the formation of the oxide films in the surface of the plated steel sheet can be suppressed and the disadvantages in the operation and quality can be eliminated using this technique, and have contrived the present invention on the basis of this finding.

The main points of the present invention are as below.

(1) A method for producing a hot dip plated steel sheet, the method controlling a coating weight by injecting a gas toward a surface of a steel sheet from a time when the steel sheet continuously immersed into a plating bath is pulled up from the plating bath to a time when plating metal adhered onto the surface of the steel sheet is solidified, the method includes: setting an oxygen concentration of a bath surface of the plating bath to be more than or equal to 0.05 vol % and less than or equal to 21 vol % when the gas is injected toward the surface of the steel sheet; and setting an oxygen concentration in a space of an end of the steel sheet at a position where the gas collides with the steel sheet pulled up from the plating bath to be more than or equal to 0.05 vol % and less than or equal to 3 vol % when the gas is injected toward the surface of the steel sheet.

(2) The method for producing the hot dip plated steel sheet described in the above (1), wherein the oxygen concentration of the space is set to be more than or equal to 0.05 vol % and less than or equal to 1.5 vol %.

(3) The method for producing the hot dip plated steel sheet described in the above (1) or (2), wherein the space has a barrier against an ambient atmosphere so as to control the atmosphere, and is disposed so as to include at least the end of the steel sheet.

(4) The method for producing the hot dip plated steel sheet described in the above (1) or (2), wherein the oxygen concentration of the bath surface of the plating bath is not controlled.

(5) The method for producing the hot dip plated steel sheet described in the above (1) or (2), wherein the space includes at least a region, the region is from the position where the gas collides with the steel sheet to a position of more than or equal to 5 mm on the downstream side in the sheet feeding direction of the steel sheet, and, the region is from the end of the steel sheet to a position more than or equal to 50 mm and less than or equal to 400 mm in the sheet width direction.

(6) The method for producing the hot dip plated steel sheet described in the above (1) or (2), wherein a plurality of the spaces is provided in the sheet width direction of the steel sheet, and a width of a gap between the adjacent spaces is more than or equal to 10 mm.

(7) The method for producing the hot dip plated steel sheet described in the above (1) or (2), wherein the space is set so that an area covering the steel sheet becomes smaller in a direction from the end of the steel sheet to the center in the sheet width direction of the steel sheet.

(8) The method for producing the hot dip plated steel sheet described in the above (1) or (2), wherein the coating weight of one surface of the steel sheet from the end of the steel sheet to a position of 10 mm in the sheet width direction is more than or equal to 50 $g/m^2$ and less than or equal to 380 $g/m^2$.

(9) The method for producing the hot dip plated steel sheet described in the above (1) or (2), wherein the plating bath contains at least one of Zn, Al, Mg, Si, Sr, Cr, Sn, and Ca.

(10) The method for producing the hot dip plated steel sheet described in the above (1) or (2), wherein the plating bath is a Zn-based plating bath containing Al more than or equal to 0.1 mass % and less than or equal to 60 mass % and Mg more than or equal to 0.2 mass % and less than or equal to 5 mass %.

(11) An apparatus for hot dip plating includes: a plating bath into which a steel sheet moving through a production line is continuously immersed; a gas wiping nozzle which injects a gas toward a surface of the steel sheet pulled up from the plating bath; a seal box which is provided at a position spaced from a bath surface of the plating bath and covers a space of an end of the steel sheet at a position where the gas collides with the steel sheet pulled up from the plating bath; and a purge gas supply member which introduces an inert gas into the seal box so as to control an oxygen concentration inside the seal box.

(12) The apparatus for hot dip plating described in the above (11), wherein the purge gas supply member controls the oxygen concentration inside the seal box to be more than or equal to 0.05 vol % and less than or equal to 3 vol %.

(13) The apparatus for hot dip plating described in the above (11), wherein the purge gas supply member controls the oxygen concentration inside the seal box to be more than or equal to 0.05 vol % and less than or equal to 1.5 vol %.

(14) The apparatus for hot dip plating described in the above (11), wherein at least a pair of the seal boxes is provided at positions facing each other with the steel sheet interposed therebetween, and injects a gas toward the steel sheet so as to seal a region between the seal boxes facing each other by a gas curtain.

(15) The apparatus for hot dip plating described in the above (11), wherein the seal box is provided so as to cover an assisting nozzle for assisting the gas injection of the wiping nozzle in the vicinity of the wiping nozzle.

(16) The apparatus for hot dip plating described in the above (11), further includes: a seal box moving mechanism which moves the seal box in the sheet width direction in accordance with the sheet width of the steel sheet.

(17) The apparatus for hot dip plating described in the above (11), wherein the seal box covers a space including at least a region, the region is from the position where the gas collides with the steel sheet to a position of more than or equal to 5 mm on the downstream side in the sheet feeding direction of the steel sheet, and, the region is from the end of the steel sheet to a position more than or equal to 50 mm and less than or equal to 400 mm in the sheet width direction of the steel sheet.

(18) The apparatus for hot dip plating described in the above (11), wherein a plurality of the seal boxes is provided in the sheet width direction of the steel sheet, and a width of a gap between the adjacent spaces is more than or equal to 10 mm.

(19) The apparatus for hot dip plating described in the above (11), wherein the seal box has a shape in which an area covering the steel sheet becomes smaller in a direction from the end of the steel sheet to the center in the sheet width direction of the steel sheet.

(20) The apparatus for hot dip plating described in the above (11), wherein a length of the seal box in the sheet width direction of the steel sheet is more than or equal to a sheet width of the steel sheet.

(21) The apparatus for hot dip plating described in the above (11), wherein the seal box includes a gas injection member which injects a gas toward the steel sheet, and the gas injection member is provided in an end of the seal box facing the steel sheet.

(22) The apparatus for hot dip plating described in the above (11), wherein the seal box includes a gas injection member which injects a gas toward the steel sheet, and the gas injection member is formed in an L-shape.

In the present invention, in the method for producing the hot dip plated steel sheet and the apparatus for the hot dip plating used in the method, it is possible to decrease the oxygen concentration in the seal box by installing a seal box smaller than seal boxes of the conventional techniques so as to cover at least the steel sheet edge in the gas injection position where the coating weight is controlled. According to the present invention, by means of the technique, it is possible to suppress the formation of the oxide films on the surface of the plated steel sheet and to easily and visually recognize the gas injection position for controlling the coating weight. In addition, it is easy to remove the surface oxide films formed on the surface of the plating bath or to maintain the wiping nozzle. Furthermore, according to the present invention, since it is possible to suppress the generation of zinc fume by the oxide films on the surface of the plating liquid, it is possible to ensure the quality of the plating by preventing metallic zinc from being adhered onto the apparatus such as the wiping nozzle. Thus, according to the present invention, it is possible to use the controlling technique of the coating weight for practical application so as to suppress the formation of the oxide films in the end of the plated steel sheet without degrading the operability and the plating quality.

DETAILED DESCRIPTION OF THE INVENTION

Figure 1:
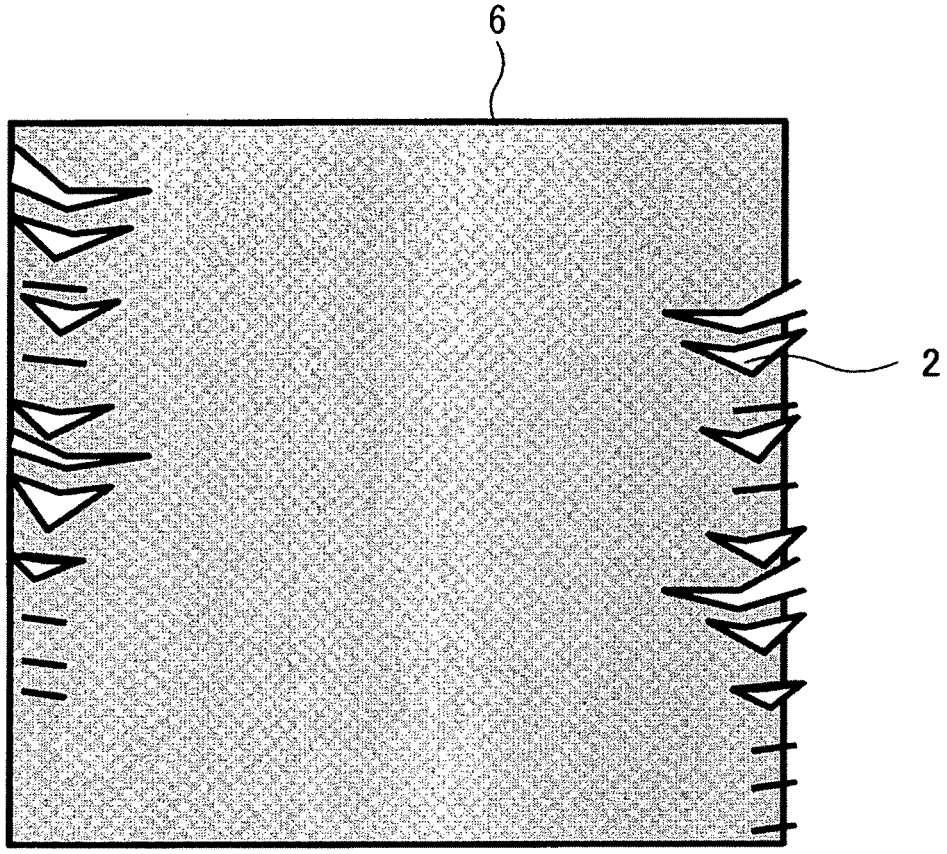
FIG. 1 is an explanatory diagram showing an example of oxide films formed on a surface of a plated steel sheet.

Hereinafter, preferred embodiments of the present invention will be described in detail with reference to the accompanying drawings. In the specification and the drawings, the same reference numerals will be given to the members substantially having the same function and configuration, and the repetitive description thereof will be omitted.

(Mechanism of Forming Oxide Films)

Figure 2A:
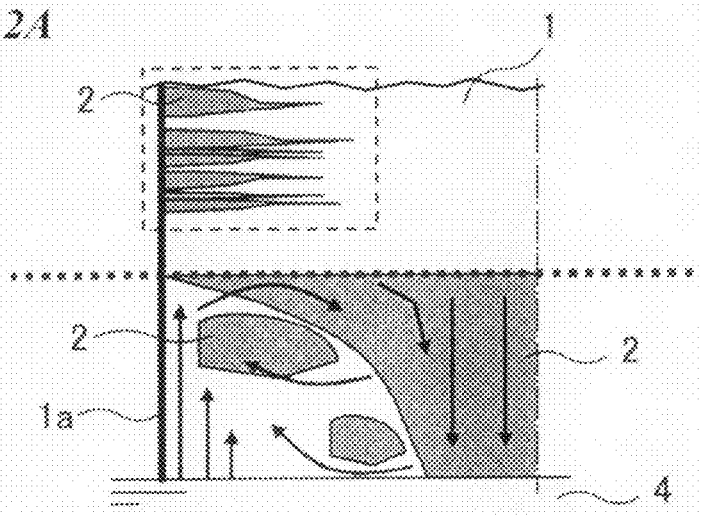
FIG. 2A is an explanatory diagram showing a mechanism for forming the oxide films shown in FIG. 1, and is a front view (of the left half side of the steel sheet) showing a surface condition of the plated steel sheet.
Figure 2B:
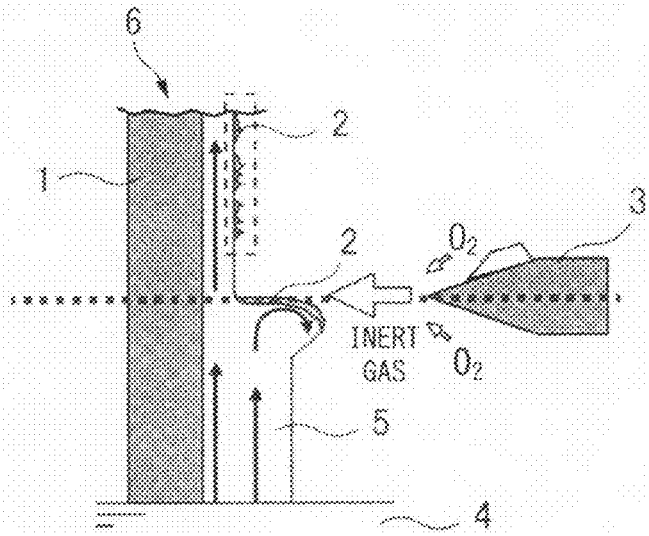
FIG. 2B is an explanatory diagram showing the mechanism for forming the oxide films shown in FIG. 1, and is a side view showing the surface condition in the vicinity of a steel sheet edge of the plated steel sheet.
Figure 2C:
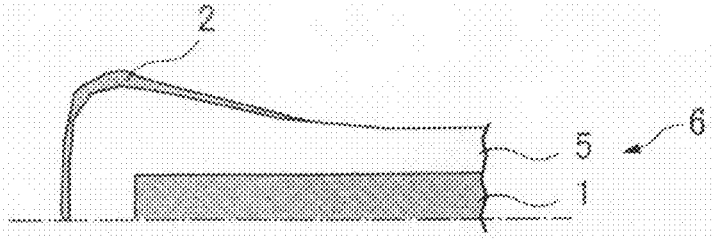
FIG. 2C is an explanatory diagram showing the mechanism for forming the oxide films shown in FIG. 1, and is a sectional view showing the condition in the vicinity of a steel sheet edge of the plated steel sheet.

Before the description of the present invention, a mechanism for forming oxide films (dross) formed on a surface of a plated steel sheet will be described with reference to FIGS. 1, 2A, 2B, and 2C. FIG. 1 is an explanatory diagram showing an example of oxide films formed on the surface of the plated steel sheet. In addition, FIGS. 2A, 2B, and 2C are explanatory diagrams showing a mechanism for forming oxide films shown in FIG. 1. FIG. 2A is a front view showing a surface condition of the left side of the plated sheet rather than the center thereof. FIG. 2A shows a condition in which plating liquid accompanying the steel sheet pulled up from a plating bath 4 is scraped to be dropped at the dotted line by an impact pressure of wiping gas on the basis of the formation and flow of the oxide films 2. FIG. 2B is a side view showing the surface condition in the vicinity of a steel sheet edge of the plated steel sheet. FIG. 2C is a sectional view showing the condition in the vicinity of a steel sheet edge of the plated steel sheet.

As shown in FIG. 1, the oxide films 2 formed on the surface of a plated steel sheet 6 and remaining thereon after the plating are mainly formed in the end (edge) of the plated steel sheet 6 so as to have a whisker shape. The formation of the oxide films 2 having a whisker shape is not desirable in that the appearance of the product is degraded. In order to resolve the mechanism for forming the oxide films 2, the inventors specifically observed the surface of the plated steel sheet 6 in the region from a bath surface of the plating bath to an injection position (a position where the wiping gas collides with the surface of the steel sheet, a wiping portion) of a gas (wiping gas) injected from a wiping nozzle 3 for controlling a coating weight. As a result, as shown in FIGS. 2A and 2B, it was observed that the oxide films 2 were formed throughout the entire width of the steel sheet 1 at the wiping gas injection position. It is thought that this is due to the following reason. As shown in FIG. 2B, the wiping gas injected from the wiping nozzle 3 involves the peripheral air by means of the ejector effect. For this reason, even when an inert gas is used as the wiping gas, the wiping gas injected toward the plated steel sheet is mixture gas mixed with air containing $O_2$. Since the mixture gas containing $O_2$ strongly collides with the surface of the steel sheet 1, oxygen is heavily supplied to the wiping portion, and plating metal 5 is easily oxidized. In addition, because the plating liquid at the wiping portion is scraped so as to be dropped therefrom, a newly-formed surface which is not oxidized is continuously formed, and thereby the plating metal 5 is easily oxidized. For this reason, it is thought that the oxide films 2 are formed throughout the entire width of the steel sheet 1 at the wiping gas injection position.

In addition, the inventors have obtained the following findings. As shown in FIG. 2A, a liquid flow depicted by the arrow in FIG. 2A is developed in the surface of the steel sheet 1 on which the wiping gas is injected. The oxide films 2 formed at the center of the steel sheet 1 at the wiping portion are scraped to be dropped to the bath surface of the plating bath 4. However, the oxide films 2 formed at the end (steel sheet edge 1*a*) of the steel sheet 1 at the wiping portion remain in the surface of the steel sheet 1 without being scraped to be dropped therefrom. This is because the downward flow of the plating liquid at the end of the steel sheet 1 is smaller than that at the center thereof, the plating liquid is not sufficiently scraped to be dropped therefrom, and then a force for making the oxide films 2 be dropped to the bath surface of the plating bath is not sufficient. In fact, as is generally known, since the coating weight at the end of the steel sheet 1 is larger than that at the center thereof as shown in FIG. 2C, it is understood that the plating liquid at the steel sheet edge 1*a* is not sufficiently scraped to be dropped therefrom. In addition, the inventors found that the oxide films 2 are divided by the wiping gas to be a whisker shape when the oxide films 2 remaining in the vicinity of the steel sheet edge 1*a* pass through the wiping gas injection position. As shown in FIG. 2C, the whisker-shaped oxide films 2 are easily formed when the coating weight is large.

The whisker-shaped oxide films 2 are formed in the steel sheet edge 1*a* at the wiping gas injection position. For this reason, the inventors thought that the degraded appearance of the plated steel sheet 1 was improved by suppressing the formation of the oxide films 2 in the steel sheet edge 1*a* at the wiping gas injection position so as to suppress the formation of the whisker-shaped oxide films 2 remaining at the end of the plated steel sheet 1.

Here, it is thought that the formation of the oxide films 2 on the surface of the plated steel sheet 6 is largely influenced by the oxygen concentration in the vicinity of the formation position where the oxide films 2 are formed. For this reason, a relationship between the formation of the whisker-shaped oxide films 2 and the oxygen concentration in the steel sheet edge 1*a* at the wiping gas injection position was studied. As a result, as described below, the inventors found that the formation of the whisker-shaped oxide films is remarkably suppressed by setting the oxygen concentration in a space including at least the steel sheet edge 1*a* at the wiping gas injection position to a predetermined range of oxygen concentration, and thereby contrived the present invention. Hereinafter, the preferred embodiments of the present invention will be described in detail.

(Method for Producing Hot Dip Plated Steel Sheet)

First, a method for producing a hot dip plated steel sheet according to the present invention will be described in detail. In the method for producing the hot dip plated steel sheet according to the present invention, when the coating weight is controlled by injecting a gas toward the surface of the steel sheet from a time when the steel sheet continuously immersed into the plating bath is pulled up from the plating bath to a time when plating metal adhered to the surface of the steel sheet is solidified, the plating is performed on the basis of the following conditions (A) and (B).

(A) The oxygen concentration of the bath surface of the plating bath is set to be more than or equal to 0.05 vol % and less than or equal to 21 vol %. The oxygen concentration of the bath surface of the plating bath need not be controlled.

(B) The oxygen concentration in a space of the end (steel sheet edge) of the steel sheet at a position where the gas collides with the steel sheet pulled up from the plating bath is set to be more than or equal to 0.05 vol % and less than or equal to 3 vol %, and preferably more than or equal to 0.05 vol % and less than or equal to 1.5 vol %.

(Condition of Bath Surface of Plating Bath)

Regarding the condition (A), as described above, in the conventional techniques, the bath surface of the plating bath was covered with a seal box or the like so as to be isolated from the ambient atmosphere. However, in the techniques of sealing an entire region from the bath surface of the plating bath to the gas injection position of the wiping nozzle using a seal box, the advantage of suppressing the formation of the oxide films is obtained, but it is difficult to visually recognize the gas injection position for controlling the coating weight which is important for the hot dip plating operation. In addition, it is difficult to remove surface oxide films formed on the surface of the plating bath or to maintain the wiping nozzle. For this reason, there is a problem in that it is difficult to perform the operation. In addition, if the surface of the plating liquid is not covered by a certain amount of oxide films, zinc fume is generated from the surface. When metallic zinc is adhered to an apparatus such as the wiping nozzle due to the zinc fume, it is not possible to normally perform the wiping operation. For this reason, there is a problem in that the quality of the product is degraded. Furthermore, since it is not necessary to control the oxygen concentration of the bath surface of the plating bath, it is possible to decrease the used amount of an inert gas and to decrease the operation cost.

Meanwhile, in the present invention, the condition (B) to be described later is sufficiently satisfied by sealing a space of the end (steel sheet edge) of the steel sheet at a position where a gas collides with the steel sheet pulled up from the plating bath by means of a seal box or the like. In addition, in the present invention, since it is possible to allow the bath surface of the plating bath to have the ambient atmosphere, it is possible to remarkably decrease the size of the seal box or the like. As a result, since it is easy to visually recognize the gas injection position for controlling the coating weight, it is easy to remove the surface oxide films formed on the surface of the plating bath or to maintain the wiping nozzle. In addition, since it is possible to suppress the generation of the zinc fume by means of the oxide films on the surface of the plating bath, it is possible to prevent the metallic zinc from being adhered to the apparatus such as the wiping nozzle and thus to ensure the quality of the plating. Furthermore, the inventors found that the molten plating liquid evaporates when the oxygen concentration is less than 0.05 vol %. Due to the evaporation of the molten plating liquid (the molten plating liquid of the surface of the plating bath), the apparatuses in the vicinity of the wiping portion are contaminated. As a result, the wiping nozzle is clogged, and a difference in coating weight may be generated. Accordingly, the oxygen concentration of the bath surface of the plating bath is set to be more than or equal to 0.05 vol % and less than or equal to 21 vol % (the oxygen concentration of the ambient atmosphere).

(Control of Oxygen Concentration)

Regarding the condition (B), as a result of the study, the inventors obtained the findings that the oxygen concentration in a space of the end (steel sheet edge) of the steel sheet at a position where a gas collides with the steel sheet pulled up from the plating bath is required to be set to a predetermined range. Specifically, on the basis of the findings obtained from the embodiments to be described later, the inventors found that the formation of the whisker-shaped oxide films is suppressed when the oxygen concentration in a space of the steel sheet edge at a position where a gas collides with the steel sheet pulled up from the plating bath is not more than 3 vol % and the formation of the whisker-shaped oxide films is remarkably suppressed when the oxygen concentration in the space of the steel sheet edge is not more than 1.5 vol %. Thus, in the method for producing the hot dip plated steel sheet according to the present invention, the oxygen concentration in the space of the steel sheet edge is set to be less than or equal to 3 vol %, and preferably less than or equal to 1.5 vol %. In addition, as described above, the inventors found that the molten plating liquid evaporates when the oxygen concentration is not more than 0.05 vol %. Due to the evaporation of the molten plating liquid (the molten plating liquid on the surface of the plated steel sheet), the apparatuses in the vicinity of the wiping portion is contaminated. As a result, the wiping nozzle is clogged, and a difference in coating weight may be generated. When the oxygen concentration in the space of the steel sheet edge is set to be more than or equal to 0.05 vol %, the generation of zinc fume in the space (for example, the inside of the seal box) of the steel sheet edge is suppressed due to the oxide films on the surface of the plated steel sheet. For this reason, since it is possible to prevent metallic zinc from being adhered to the apparatus such as the wiping nozzle, it is possible to ensure the quality of the plating. Accordingly, the oxygen concentration in the space of the steel sheet edge is set to be more than or equal to 0.05 vol %.

Although it will be described later in detail, as a method for controlling the oxygen concentration, for example, the oxygen concentration inside the edge seal box can be controlled in such a manner that the space requiring the control of the oxygen concentration is sealed by the edge seal box and an inert gas such as nitrogen or argon is introduced into the edge seal box. As described above, in order to suppress the formation of the whisker-shaped oxide films, it is necessary to prevent the involvement of oxygen caused by the ejector effect of the wiping gas. Accordingly, it is preferable that the space requiring the control the oxygen concentration have a barrier against the ambient atmosphere for the purpose of the atmosphere control. "The barrier" in the present invention includes a gas curtain and a gas barrier formed by purge gas such as a gas flow from the seal box to the ambient atmosphere, which will be described later, in addition to a barrier such as the seal box physically blocking the inflow of gas. The space requiring the control of the oxygen concentration may be shifted in accordance with the plating condition or whether the operation is performed or not, but it is preferable that the space be disposed so as to include at least the steel sheet edge.

In addition, it is preferable that the space having the oxygen concentration set to be more than or equal to 0.05 vol % and less than or equal to 3 vol % include at least a region from the collision position of the wiping gas to a position of 5 mm or more on the downstream side in the sheet feeding direction and from the end of the steel sheet to a position of 50 mm or more in the sheet width direction. That is, "the space" of the end of the steel sheet in the present invention is, for example, a space including at least a region from the end of the steel sheet to a position of 50 mm or more in the sheet width direction. When the space requiring the control of the oxygen concentration includes at least a region obtained by adding the length of the whisker-shaped oxides to 50 mm or so in the sheet width direction, it is possible to sufficiently suppress the formation of the whisker-shaped oxide films on the surface of the plated steel sheet. Accordingly, in consideration of the case where the whisker-shaped oxide films are not formed, it is preferable that the space requiring the control of the oxygen concentration include at least a region from the end of the steel sheet to a position of 50 mm or more in the sheet width direction. In addition, as shown in FIG. 2, in the case where the oxygen concentration is not controlled, the length of the formed whisker-shaped oxide films is 80 mm or so at the maximum in the horizontal direction. Therefore, it is more preferable that the space requiring the control of the oxygen concentration include at least a region of 200 mm or more which is about twice the length of the whisker-shaped oxide films. Of course, on the assumption that the condition (A) is satisfied, the space requiring the control of the oxygen concentration may be further widened. However, if a wide space is covered with the seal box or the like, the seal box or the like increases in size. For this reason, from the viewpoint of preventing the inconvenience in operation, it is preferable that the space requiring the control of the oxygen concentration be made to be as small as possible. For example, in the case where the movable seal box described later is used, it is preferable that the space requiring the control of the oxygen concentration be set to a region from the end of the steel sheet to a position of 400 mm or less in the sheet width direction. In addition, in order to easily and visually recognize the gas injection position, it is preferable that the space requiring the control of the oxygen concentration be set to a region from the collision position of the wiping gas to a position of 200 mm or less on the downstream side in the sheet feeding direction. Furthermore, in order to ensure the movability of the seal box, it is preferable that the space requiring the control of the oxygen concentration be set to a region from the surface of the steel sheet to a position of 200 mm or less in a direction perpendicular to the surface of the steel sheet. In order to prevent the steel sheet from contacting the seal box to be described later, it is preferable that the space requiring the control of the oxygen concentration be set to a region from the surface of the steel sheet to a position of 3 mm or more in a direction perpendicular to the surface of the steel sheet. A region of the steel sheet in the sheet feeding direction included in the space requiring the control of the oxygen concentration may include the upstream side in the sheet feeding direction in addition to the downstream side in the sheet feeding direction. However, since it is necessary to satisfy the condition (A), the region on the upstream side in the sheet feeding direction has to be located above the bath surface of the plating bath.

Furthermore, in order to visually recognize the gas injection position, a plurality of spaces requiring the control of the oxygen concentration may be provided in the sheet width direction so that the width of the gaps between the adjacent spaces is more than or equal to 10 mm. In order to prevent a difference in the coating weight, the space requiring the control of the oxygen concentration may be set so that an area covering the steel sheet becomes smaller from the steel sheet edge to the center of the steel sheet in the width direction.

(Composition of Plating Bath)

The whisker-shaped oxide films are formed even in a typical plating composition of a Zn-based plating bath containing 0.2 mass % or less of Al. However, the whisker-shaped oxide films formed by the oxidization of plating metal are easily formed in the case where the plating bath contains a large amount of easily oxidized elements such as Al or Mg. Specifically, for example, if the plating bath is a Zn-based plating bath, as a range for practical use in operation, the plating bath may contain Al more than or equal to 0.1 mass % and less than or equal to 60 mass % and Mg more than or equal to 0.2 mass % and less than or equal to 5 mass %. Particularly, if the concentration of Al or Mg is close to the upper limit of the range, the whisker-shaped oxide films are easily formed. According to the method for producing the hot dip plated steel sheet of the present invention, it is possible to obtain the advantage of remarkably suppressing the formation of the whisker-shaped oxide films even in the composition of the plating bath in which the whisker-shaped oxide films are easily formed. In addition, the plating bath may contain Si more than or equal to 0.1 mass % and less than or equal to 0.25 mass %. In the present invention, since the oxygen concentration causing the formation of the oxide films is reduced, it is possible to obtain the advantage of suppressing the formation of the whisker-shaped oxide films even in the compositions (the plating containing elements such as Zn, Al, Mg, Sn, Si, Sr, Cr, and Ca) of other plating baths in which the whisker-shaped oxide films are easily formed. That is, the plating bath may contain at least one of Zn, Al, Mg, Sn, Si, Sr, Cr, and Ca. For example, a Zn-based plating bath may contain a plurality of elements.

(Coating Weight)

Figure 3:
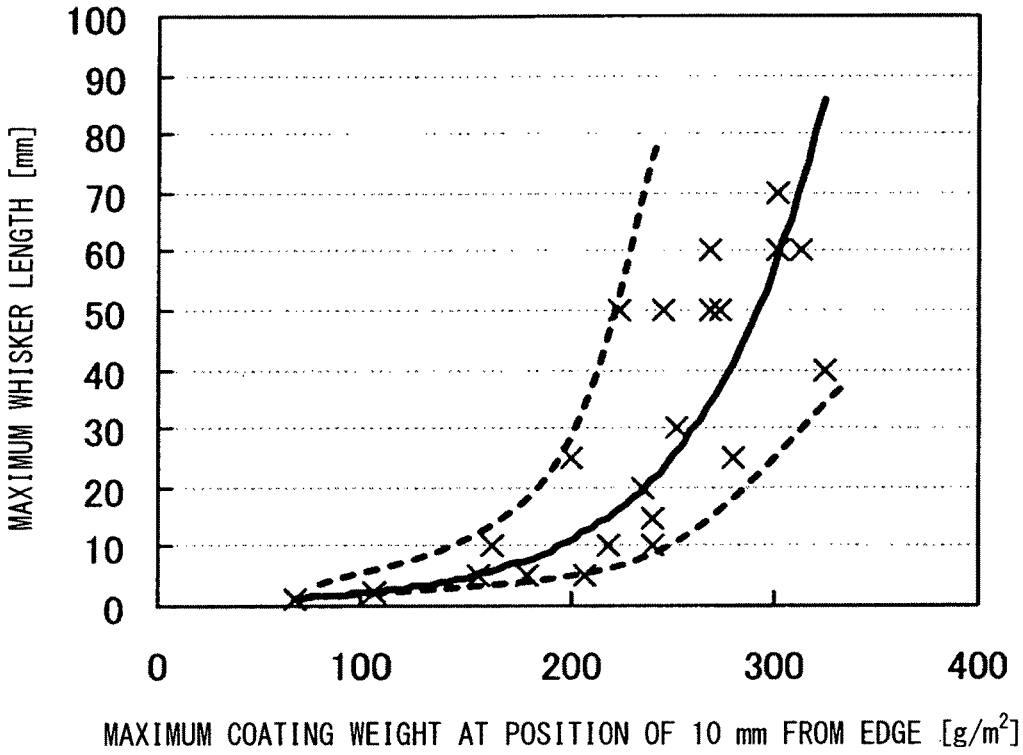
FIG. 3 is a graph showing an example of a result obtained by measuring a maximum length of whisker-shaped oxide films formed by changing a coating weight in the vicinity of the steel sheet edge.

In addition, when the plating removal amount (the amount of the plating scraped by the wiping gas to be dropped) is small, the whisker-shaped oxide films are easily formed. The inventors have studied the range of the coating weight in which the whisker-shaped oxide films are easily formed. Specifically, in the condition that the oxygen concentration was not controlled, the gas supply amount was controlled through the wiping nozzle so as to change the coating weight in the region from the steel sheet edge to a position of 10 mm in the sheet width direction, and the maximum length of the formed whisker-shaped oxide films were measured. The result is shown in FIG. 3. The longitudinal axis in FIG. 3 indicates the maximum length of the whisker-shaped oxide films, and the horizontal axis indicates the coating weight in the region from the steel sheet edge to the position of 10 mm in the sheet width direction.

As shown in FIG. 3, it is understood that the whisker-shaped oxide films are easily formed in the case where the coating weight of one surface in the region from the steel sheet edge to the position of 10 mm in the sheet width direction is set to be more than or equal to 50 $g/m^2$. According to the method for producing the hot dip plated steel sheet of the present invention, it is possible to obtain the advantage of suppressing the formation of the whisker-shaped oxide films even in the range of the coating weight in which the whisker-shaped oxide films are easily formed. Accordingly, the coating weight of one surface in the region from the steel sheet edge to the position of 10 mm in the sheet width direction may be set to be more than or equal to 50 $g/m^2$.

However, when the coating weight is too large, it is not possible to ensure the satisfactory appearance of the obtained plated steel sheet. For this reason, it is preferable that the coating weight of one surface in the region from the steel sheet edge to the position of 10 mm in the sheet width direction be set to be less than or equal to 380 $g/m^2$.

As described above, the method for producing the hot dip plated steel sheet according to the present invention is described in detail. Hereinafter, an apparatus for hot dip plating according to the embodiments used in the method for producing the hot dip plated steel sheet will be described in detail.

(Apparatus for Hot Dip Plating According to First Embodiment of the Present Invention)

Figure 4:
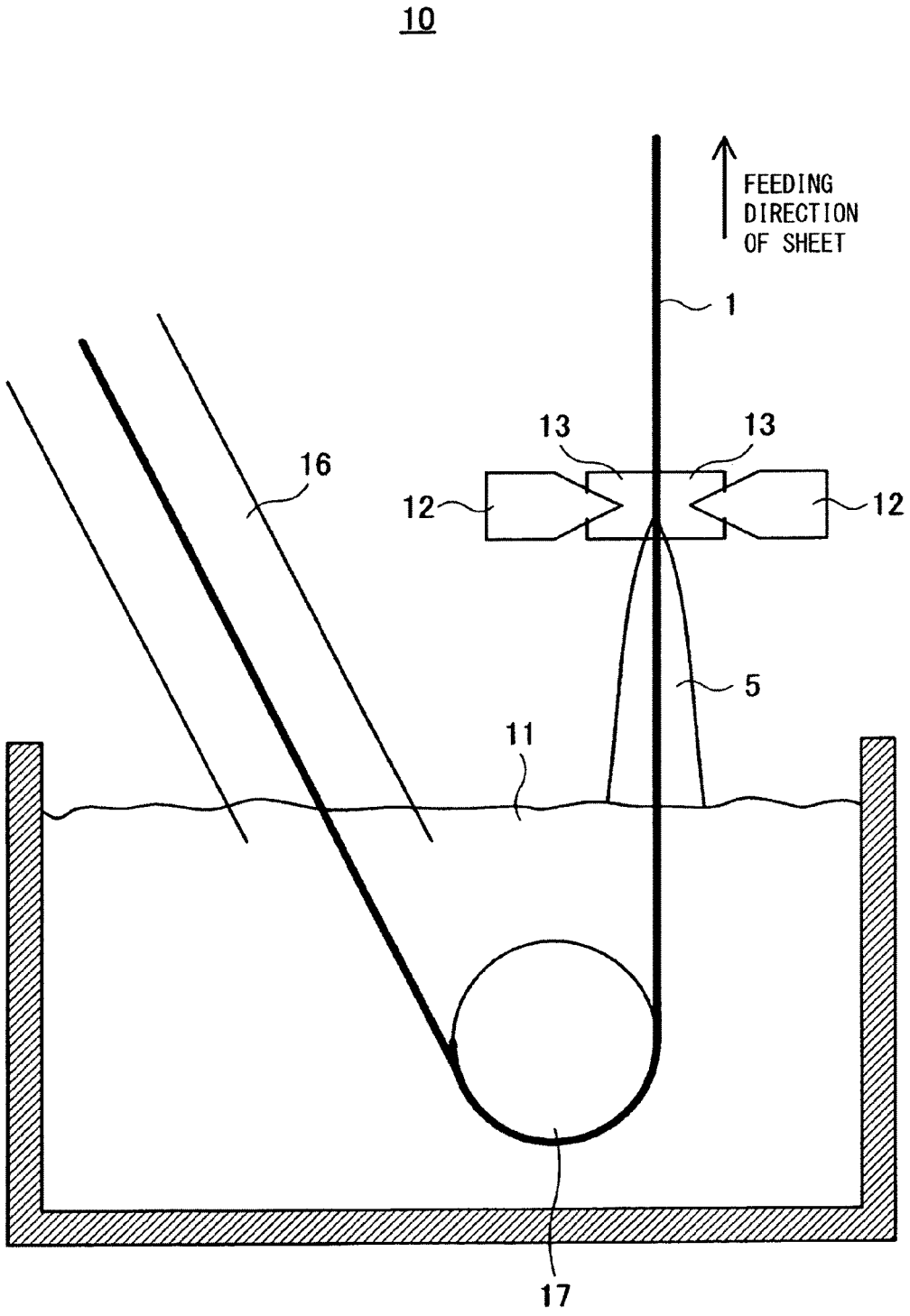
FIG. 4 is an explanatory diagram showing an entire configuration of an apparatus for hot dip plating according to a first embodiment of the present invention.

First, an entire configuration of an apparatus for hot dip plating according to a first embodiment of the present invention will be described with reference to FIG. 4. FIG. 4 is an explanatory diagram showing an entire configuration of an apparatus 10 for hot dip plating according to the first embodiment of the present invention.

As shown in FIG. 4, the apparatus 10 for the hot dip plating according to the first embodiment of the present invention mainly includes a plating bath 11, gas wiping nozzles 12, seal boxes 13, and purging gas supply members. The purging gas supply member is, for example, a purge gas supply nozzle (see FIG. 5).

A steel sheet (steel strip) 1 moving through the production line is continuously immersed into the plating bath 11. In more detail, the steel sheet 1 subjected to a typical rolling process is continuously immersed into the plating bath 11 through a snout 16, the sheet feeding direction thereof is changed by a bath roll 17, and then the steel sheet 1 is pulled up in the vertical direction. As a composition of the plating bath, for example, in the case of a Zn-based plating bath, as a range for practical use in operation, the plating bath may contain Al more than or equal to 0.1 mass % and less than or equal to 60 mass % and Mg more than or equal to 0.2 mass % and less than or equal to 5 mass %. In addition, the plating bath may contain Si more than or equal to 0.1 mass % and less than or equal to 0.25 mass %. Here, as described above, when a large amount of Al or Mg is contained in the plating bath, the whisker-shaped oxide films are easily formed. However, according to the apparatus 10 for the hot dip plating of the first embodiment of the present invention, it is possible to remarkably suppress the formation of the whisker-shaped oxide films even in the composition of the plating bath.

The gas wiping nozzles 12 control the coating weight onto the surface of the steel sheet 1 by injecting a gas toward the surface of the steel sheet 1 pulled up from the plating bath 11 as described above. The gas wiping nozzles 12 are respectively disposed opposite to both surfaces of the steel sheet 1 so as to face each other and to be located above the plating bath 11 and below the position where the molten plating metal adhered onto the surface of the steel sheet 1 pulled up from the plating bath 11 is solidified. In addition, from the viewpoint of suppressing the oxidization of the plating metal using the wiping gas injected from the gas wiping nozzles 12, it is preferable that nonoxidizing gas be a main component of the wiping gas.

The seal boxes 13 are disposed at a position spaced from the bath surface of the plating bath 11, and cover the space of the end (steel sheet edge) of the steel sheet 1 at a position where the wiping gas collides with the steel sheet 1 pulled up from the plating bath 11 so that the inside of the seal boxes 13 has an atmosphere isolated from the ambient atmosphere. "The space" of the end of the steel sheet in the present invention is a region from the steel sheet edge to a position of a predetermined length at the collision position of the wiping gas to the steel sheet 1. In the apparatus 10 for the hot dip plating according to the first embodiment of the present invention, if the space of the end (steel sheet edge) of the steel sheet 1 at the position where the wiping gas collides with the steel sheet 1 pulled up from the plating bath 11 is covered by the seal boxes 13, the substantial advantage is obtained. For this reason, since it is possible to allow the bath surface of the plating bath 11 to have the ambient atmosphere, it is possible to remarkably decrease the size of the seal boxes 13 compared with the conventional seal boxes. As a result, since it is easy to visually recognize the wiping gas injection position, it is easy to remove the surface oxide films formed on the surface of the plating bath 11 and to maintain the gas wiping nozzles 12. In addition, since it is possible to suppress the generation of zinc fume due to the oxide films on the surface of the plating liquid, it is possible to prevent metallic zinc from being adhered to the apparatus such as the wiping nozzles, and thus to ensure the reliable quality of the plating.

It is preferable that the seal boxes 13 cover a space including at least a region from the collision position of the wiping gas to a position of 5 mm or more on the downstream side in the sheet feeding direction of the steel sheet 1 and from the end of the steel sheet 1 to a position more than or equal to a length (for example, 50 mm) of the whisker-shaped oxide films in the sheet width direction. That is, it is preferable that "the space" of the end of the steel sheet 1 according to the first embodiment of the present invention include at least a region from the end of the steel sheet 1 to a position more than or equal to a length (for example, 50 mm) of the whisker-shaped oxide films in the sheet width direction. When the seal boxes 13 cover at least the space, it is possible to sufficiently suppress the formation of the whisker-shaped oxide films during the plating. Naturally, on the assumption that the seal box 13 is spaced from the bath surface of the plating bath 11, each seal box 13 may increase in size. However, from the viewpoint of preventing the inconvenience in operation caused by an increase in size of the seal box 13, it is preferable that the seal box 13 be decreased in size as much as possible. The minimum horizontal length may be a length obtained by adding the length of the whisker-shaped oxide films to 50 mm or so. Accordingly, in consideration of the case where the whisker-shaped oxide films are not formed, it is preferable that the seal box 13 cover a space including at least a region from the end of the steel sheet to a position of 50 mm or more in the sheet width direction. It is more preferable that the seal box 13 cover a space including at least a region from the end of the steel sheet to a position of 200 mm or more in the sheet width direction. The region of the steel sheet 1 covered with the seal box 13 in the sheet feeding direction may include a region on the upstream side in the sheet feeding direction in addition to a region on the downstream side in the sheet feeding direction. However, since it is necessary to allow the seal box 13 to be spaced from the bath surface of the plating bath 11, the region on the upstream side in the sheet feeding direction has to be located above the bath surface of the plating bath 11. If the movable seal box to be described later is used, it is necessary to obtain the satisfactory movement (moving operation) of the seal box 13 following the steel sheet edge. Therefore, it is preferable that the length of the seal box 13 in the sheet width direction be less than or equal to 400 mm. In addition, in the operation, it is necessary to easily and visually recognize the gas injection position and to suppress a risk of the steel sheet 1 contacting the seal box 13. Therefore, it is preferable that the seal box 13 cover a region from the collision position of the wiping gas to a position of 200 mm or less (that is, the vertical height of the seal box 13 is not more than 200 mm) on the downstream side in the sheet feeding direction of the steel sheet 1. In addition, in order to ensure the movability of the seal box, it is preferable that the seal box 13 cover a region from the surface of the steel sheet to a position of 200 mm or less in a direction perpendicular to the surface of the steel sheet. Furthermore, in order to prevent the seal box from contacting the steel sheet, it is preferable that the seal box 13 cover a region from the surface of the steel sheet to a position of 3 mm or more in a direction perpendicular to the steel sheet.

The purge gas supply members (for example, the purge gas supply nozzle) introduces an inert gas such as nitrogen or argon into the seal box 13 so that the oxygen concentration inside the seal box 13 is controlled to be more than or equal to 0.05 vol % and less than or equal to 3 vol %, and preferably more than or equal to 0.05 vol % and less than or equal to 1.5 vol %.

Figure 5A:
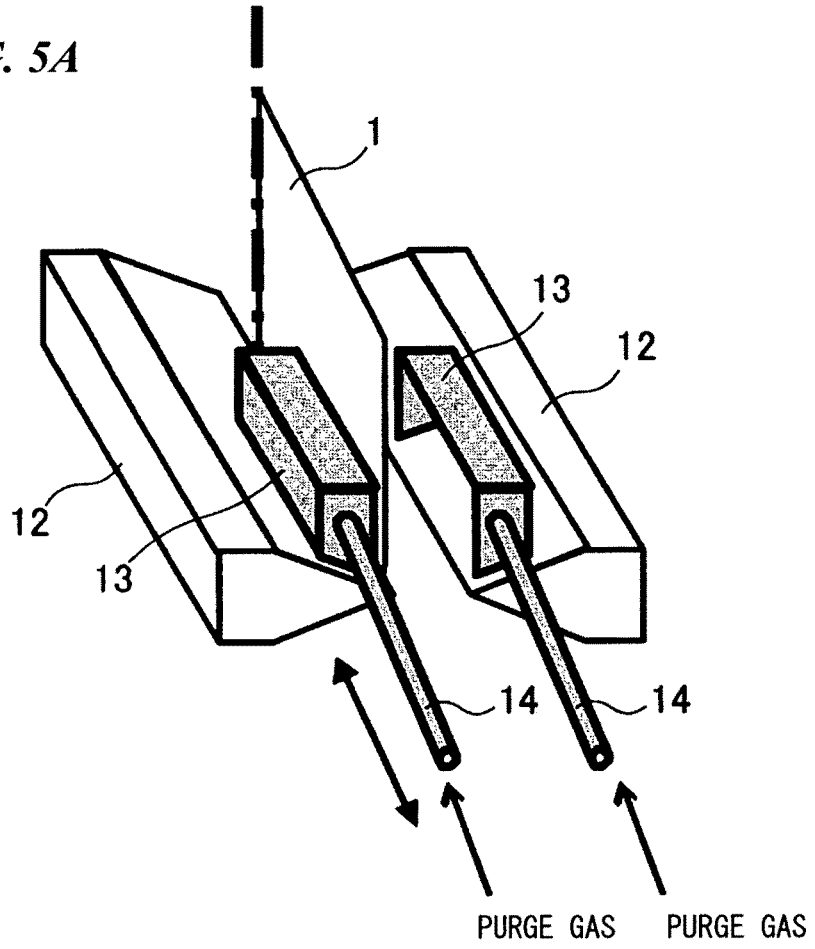
FIG. 5A is an explanatory diagram showing a configuration of seal boxes and purge gas supply members according to the embodiment.
Figure 5B:
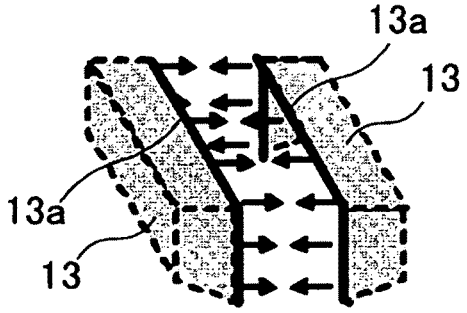
FIG. 5B is an explanatory diagram showing a gas sealing mechanism of the seal box according to the embodiment.

Next, the configuration of the seal boxes 13 and the purge gas supply nozzle 14 according to the first embodiment of the present invention will be described in detail with reference to FIGS. 5A and 5B. FIG. 5A is an explanatory diagram showing the configuration of the seal boxes 13 and the purge gas supply nozzle 14 according to the first embodiment of the present invention. FIG. 5B is an explanatory diagram showing a gas sealing mechanism of the seal box according to the first embodiment of the present invention.

As shown in FIG. 5A, the gas wiping nozzles 12 are respectively disposed at positions on the side of both surfaces of the steel sheet 1 so as to face each other. Each of the gas wiping nozzles 12 is substantially formed in a pentagonal prism shape, and the height direction (the height of the pentagonal prism) is aligned to be parallel to the sheet width direction of the steel sheet 1.

As shown in FIG. 5A, each of the seal boxes 13 is disposed in the upper portion of each of a pair of gas wiping nozzles 12 so as to cover at least the edge of the steel sheet 1. When the apparatus 10 for the hot dip plating has a configuration in which the seal box 13 covers the edge of the steel sheet 1 instead of covering the entire width of the steel sheet 1, it is possible to decrease the size of the seal box 13. Accordingly, it is possible to solve the inconvenience in operation described above.

However, in general, the width of the steel sheet 1 to be plated by the apparatus 10 for the hot dip plating is not constant. Even when the steel sheet 1 having a different width is fed to the apparatus 10 for the hot dip plating, it is necessary to always reliably cover a space including the edge (see the above description) of the steel sheet 1 in order to suppress the formation of the whisker-shaped oxide films. For this reason, in the first embodiment of the present invention, a seal box moving mechanism is provided so as to move the seal box 13 in the sheet width direction of the steel sheet 1 in accordance with the sheet width of the steel sheet 1 moving in the sheet feeding direction. The seal box moving mechanism is a mechanism for horizontally moving the seal box 13 in the sheet width direction of the steel sheet 1. For example, a moving mechanism using an air cylinder or screw may be exemplified. The seal box moving mechanism is provided even in the apparatus for the hot dip plating according to the modified examples (a part of the fifth modified example is excluded) of the first embodiment, the second embodiment, and the modified examples of the second embodiment of the present invention.

Figure 6:
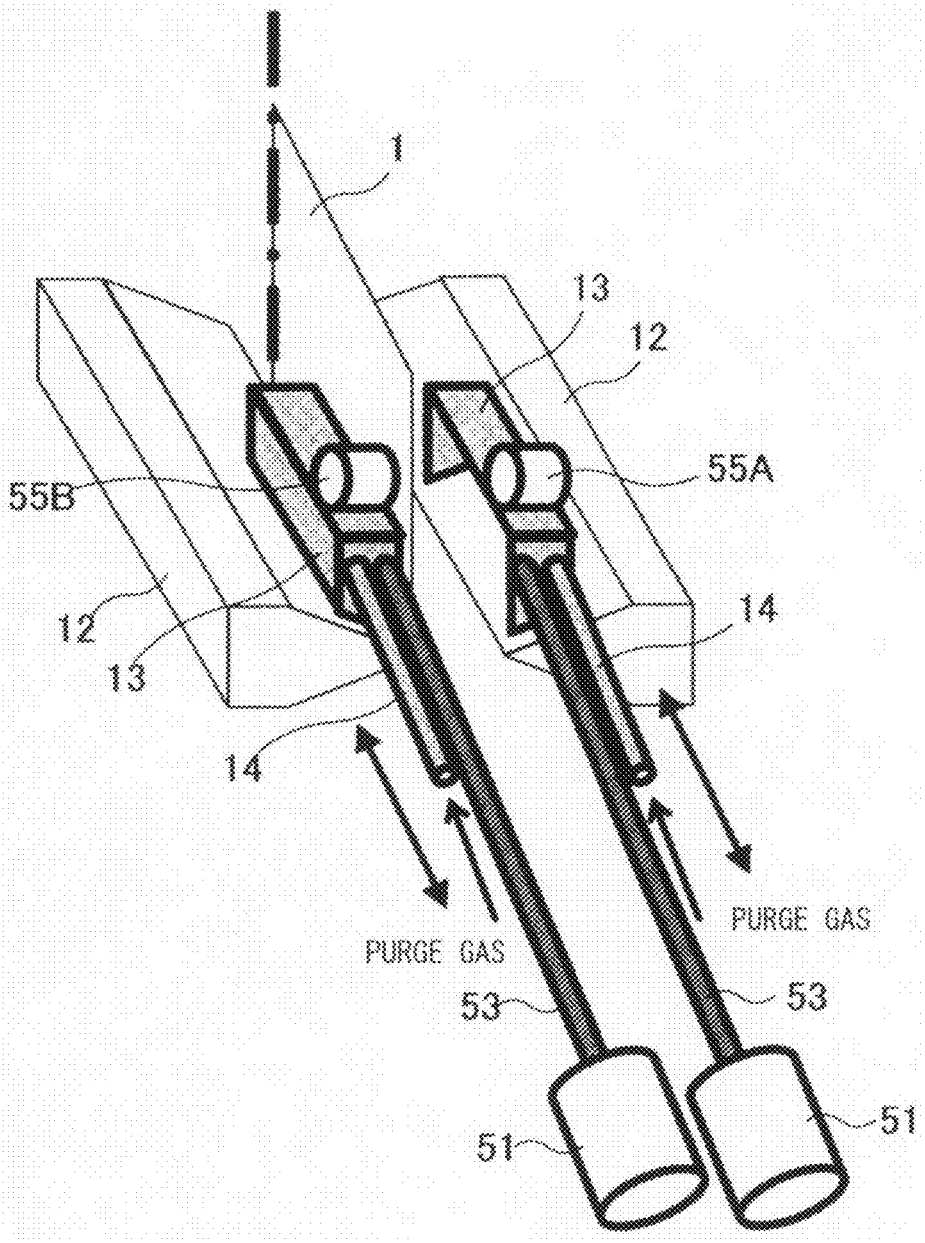
FIG. 6 is an explanatory diagram showing an example of a configuration of a seal box moving mechanism according to the embodiment.

Here, an example of the configuration of the seal box moving mechanism according to the embodiment will be described with reference to FIG. 6. FIG. 6 is an explanatory diagram showing an example of the configuration of the seal box moving mechanism according to the embodiment.

As shown in FIG. 6, the seal box moving mechanism according to the embodiment mainly includes driving motors 51, screw shafts 53, and steel sheet edge detecting sensors 55A and 55B.

Each of the driving motors 51 is connected to one end of each screw shaft 53, and rotationally drives the screw shaft 53. In addition, the screw shaft 53 is provided so that the longitudinal direction (axial direction) thereof is aligned with the sheet width direction of the steel sheet 1. In the embodiment, two screw shafts 53 respectively corresponding to the seal boxes 13 are provided so as to parallel to each other. Furthermore, the opposite end (hereinafter, referred to as "the other end") of the end (one end) of the screw shaft 53 connected to the driving motor 51 is screwed into the seal box 13.

The steel sheet edge detecting sensors 55A and 55B are disposed on the seal box 13 so as to detect the end (steel sheet edge) of the steel sheet 1. For example, each of the steel sheet edge detecting sensors 55A and 55B includes a sensor such as a photo sensor. In detail, for example, the light emitted from the steel sheet edge detecting sensor 55A including a light emitting element is received by the steel sheet edge detecting sensor 55B including a light receiving element. On the basis of the output of the light receiving element changing due to the shielded condition of the light emitted from the light emitting element, the edge position of the steel sheet 1 is detected. However, the steel sheet edge detecting sensor is not limited to the transmission-type photo sensor. For example, the steel sheet edge detecting sensor may be configured as other sensors such as a reflection-type photo sensor including a light emitting element and a light receiving element.

According to the seal box moving mechanism having the above-described configuration, when the driving motor 51 rotates the screw shaft 53, the seal box 13 screwed to the screw shaft 53 moves in the longitudinal direction (that is, the sheet width direction of the steel sheet 1) of the screw shaft 53. At this time, the edge position of the steel sheet 1 is detected by the steel sheet edge detecting sensors 55A and 55B. When the steel sheet edge detecting sensors 55A and 55B detect the edge of the steel sheet 1, it is determined that the seal box 13 is located at an appropriate position. Subsequently, the operation of driving the driving motor 51 is controlled to be stopped, so that the movement of the seal box 13 stops.

With the above-described configuration, in the apparatus for the hot dip plating according to the embodiment, the seal box 13 is moved to the above-described appropriate position for each of the sheet width of the steel sheet 1 by the seal box moving mechanism. The configuration of the seal box moving mechanism described above is only an example, and may have an arbitrary configuration provided that the configuration has a function of moving the seal box 13 in the sheet width direction of the steel sheet 1. Here, as an example, the driving motor 51 is used as a driving unit, and the screw shaft 53 is used as a driving shaft. However, for example, a cylinder may be used as a driving unit, and an air cylinder may be used as a driving shaft.

In the pair of seal boxes 13, the surface (the surface facing the steel sheet 1) on the side of the steel sheet 1 is opened, and the surface (the surface not facing the steel sheet 1 or the wiping nozzle 12) not on the side of the steel sheet 1 or the wiping nozzle 12 is closed. As shown in FIG. 5B, the seal box 13 according to the first embodiment of the present invention is provided with a nozzle 13*a* which injects a gas to the end (the bold line portion and the outline portion in FIG. 5B) of the opened surface of the steel sheet 1 as a gas injection member. Regarding the pair of seal boxes, at least one pair or more of seal boxes is disposed so as to face each other with the steel sheet 1 interposed therebetween. For this reason, when a gas (seal gas) is injected from each of the nozzles 13*a* of the pair of seal boxes 13 to the steel sheet 1, a region (space) between the pair of seal boxes 13 facing each other is sealed by a gas curtain. Accordingly, even when a distance between the pair of seal boxes 13 is long or changed, it is possible to reliably seal the edge of the steel sheet 1 by using the gas curtain. In this case, when the seal box 13 is disposed on the gas wiping nozzle 12, it is possible to easily perform a so-called wiping nozzle gap (wiping nozzle GAP) control in which the pair of gas wiping nozzles 12 moves close to the steel sheet 1 or moves away therefrom in accordance with the coating weight or the thickness of the steel sheet 1. That is, even when the distance between the pair of gas wiping nozzles 12 is changed due to the wiping nozzle gap control, it is possible to easily and reliably seal the space including the edge of the steel sheet 1 by using the seal box 13 disposed on the gas wiping nozzle 12 and the gas curtain. The shape of the seal gas injection hole of the nozzle 13*a* may be freely selected from a slit shape, a porous shape, and the like as necessary. In addition, the shape of the seal box 13 may be freely selected from a hexahedron shape, a triangular prism shape, and the like as necessary.

Furthermore, in the first embodiment of the present invention, a tubular purge gas supply nozzle 14 is provided so as to communicate with the end on the side of the steel sheet edge of the seal box 13. The longitudinal direction (the axial direction of the tube) of the purge gas supply nozzle 14 is set to be parallel to the sheet width direction of the steel sheet 1. The purge gas such as an inert gas is introduced from the purge gas supply nozzle 14 into the seal box 13, and thereby the oxygen concentration inside the seal box 13 is controlled so as to be more than or equal to 0.05 vol % and less than or equal to 3 vol % (preferably, more than or equal to 0.05 vol % and less than or equal to 1.5 vol %). It is possible to control the oxygen concentration inside the seal box 13 by controlling the supply amount of the purge gas using the purge gas supply nozzle 14.

First Modified Example of First Embodiment

Figure 7A:
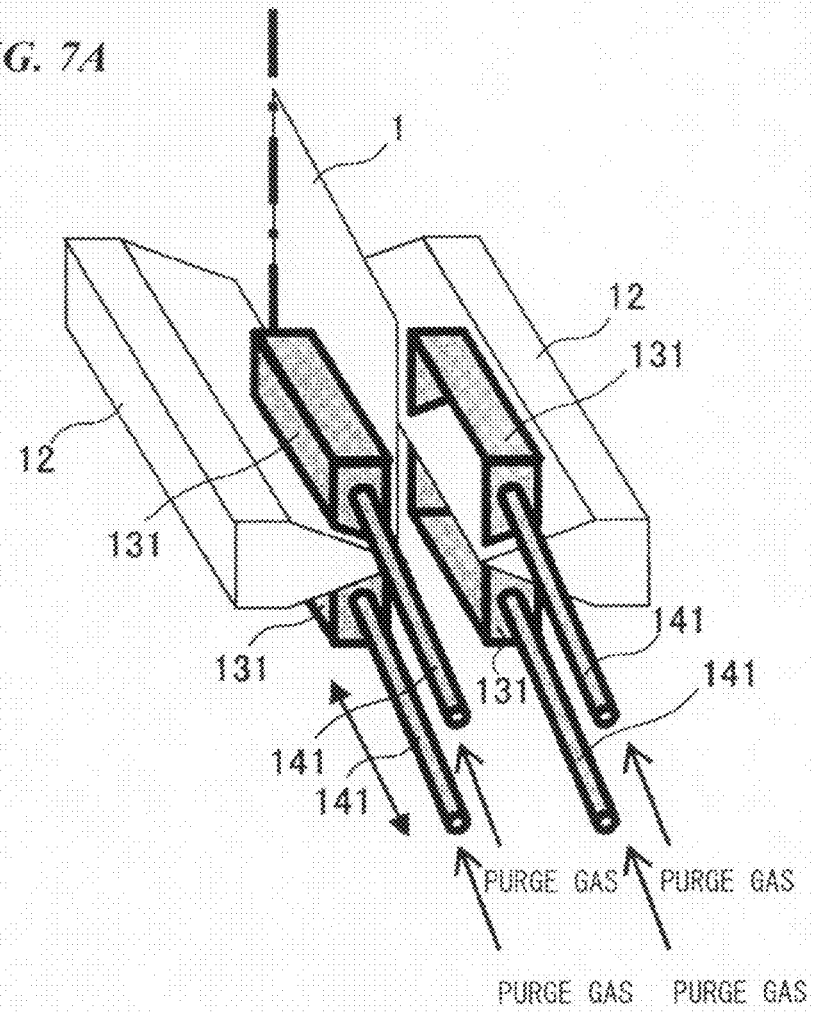
FIG. 7A is an explanatory diagram showing a configuration of the purge gas supply members and the seal boxes according to a first modified example of the embodiment.
Figure 7B:
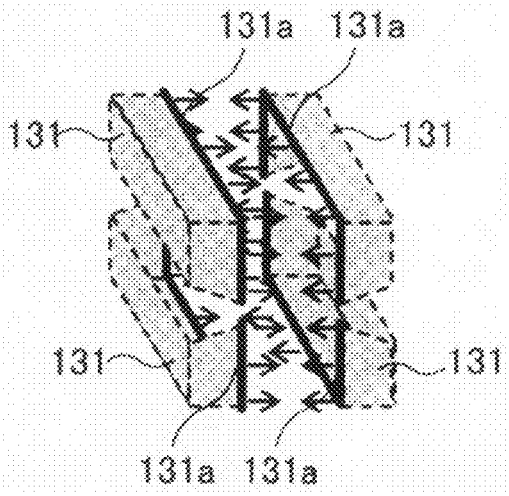
FIG. 7B is an explanatory diagram showing the gas sealing mechanism of the seal box according to the first modified example of the embodiment.

In the first embodiment of the present invention, one pair of seal boxes 13 and one pair of purge gas supply nozzles 14 are respectively provided in the both ends of steel sheets of the upper portion of the gas wiping nozzles 12, but two or more pairs of seal boxes and two or more pairs of purge gas supply nozzles may be provided therein. For example, in a first modified example of the first embodiment of the present invention, as shown in FIG. 7A, one pair (two pairs in total) of seal boxes 131 and one pair (two pairs in total) of purge gas supply nozzles 141 are respectively provided in the upper and lower portions of the gas wiping nozzle 12. Furthermore, FIG. 7B shows the gas sealing mechanism of the seal box according to the first modified example of the first embodiment.

As in the seal boxes 131 according to the modified example, when one pair of seal boxes 131 is respectively provided in both upper and lower portions of the gas wiping nozzle 12, it is possible to widen the region (space) requiring the control of the oxygen concentration in the periphery of the wiping gas injection position, that is, the position where the wiping gas collides with the steel sheet 1. For this reason, it is possible to further improve the advantage of suppressing the formation of the whisker-shaped oxide films compared with the case of the first embodiment of the present invention. Meanwhile, due to the problem related to the installation, the installation of the seal box 131 in the lower portion of the gas wiping nozzle 12 may be difficult, as in the modified example. In addition, the inventors have checked that the advantage of suppressing the formation of the whisker-shaped oxide films is sufficiently exhibited when the seal box 13 is provided in at least the upper portion of the gas wiping nozzle 12, that is, only the downstream side in the sheet feeding direction of the steel sheet 1 as in the seal box 13 according to the first embodiment. Accordingly, as in the embodiment of the present invention, the seal box may be provided in at least the upper portion of the gas wiping nozzle 12, that is, only the downstream side in the sheet feeding direction of the steel sheet 1. In addition, a plurality of the seal boxes may be provided in the sheet width direction of the steel sheet. In this case, in order to easily and visually recognize the collision position of the wiping gas, it is preferable that the width of the gap between the adjacent seal boxes be more than or equal to 10 mm.

Second Modified Example of First Embodiment

Figure 8A:
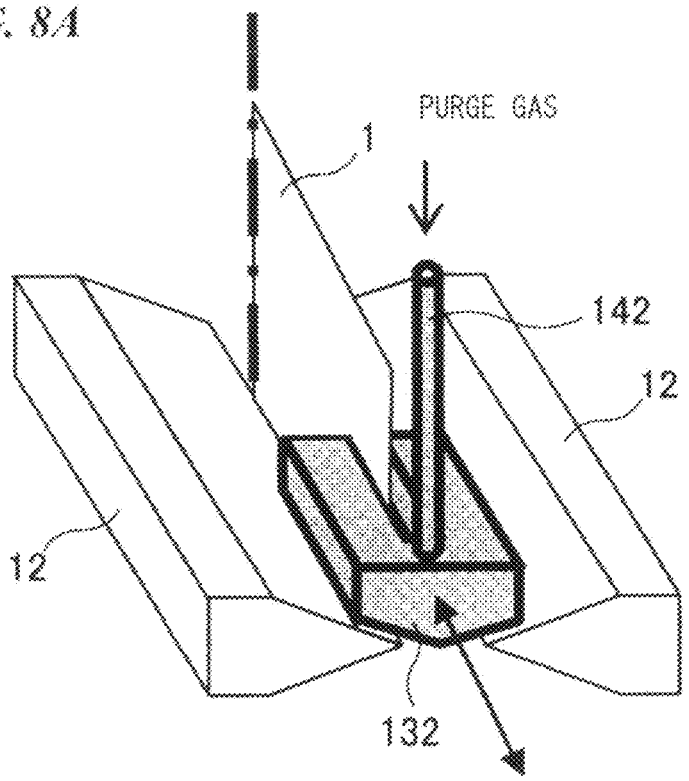
FIG. 8A is an explanatory diagram showing a configuration of the purge gas supply members and the seal boxes according to a second modified example of the embodiment.
Figure 8B:
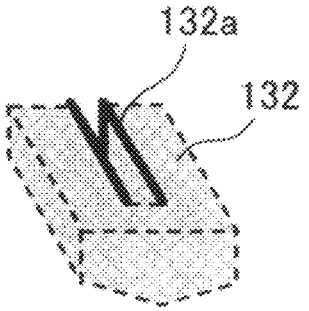
FIG. 8B is an explanatory diagram showing the gas sealing mechanism of the seal box according to the second modified example of the embodiment.

A second modified example of the first embodiment of the present invention shown in FIGS. 8A and 8B is different from the example of the first embodiment in that the shape of the seal box is different. A seal box 132 according to the modified example does not have a configuration in which the seal boxes are separately provided on both surface sides of the steel sheet 1 as in the first embodiment of the present invention, but is integrally formed in a shape (for example, substantially a U-shape) surrounding the steel sheet edge from the outside of the steel sheet edge. That is, the seal box 132 is provided so that the steel sheet 1 is interposed in the substantially U-shaped opening. In addition, as shown in FIG. 8B, a portion (the end of the opening surface) of the opening facing the steel sheet 1 is provided with a nozzle 132*a* which injects a curtain seal gas.

In addition, unlike the case of the first embodiment of the present invention, a purge gas supply nozzle 142 is provided in the upper portion of the portion (the U-shaped bottom) adjacent to the opening of the seal box 132 so that the longitudinal direction is parallel to the vertical direction.

In the case of the modified example, it is possible to further decrease the size of the seal box 132. However, the distance between two opening surfaces of the seal box 132 facing the steel sheet 1 is fixed. For this reason, the wiping nozzle gap control may be difficult compared with the case of the first embodiment of the present invention.

Third Modified Example of First Embodiment

Figure 9A:
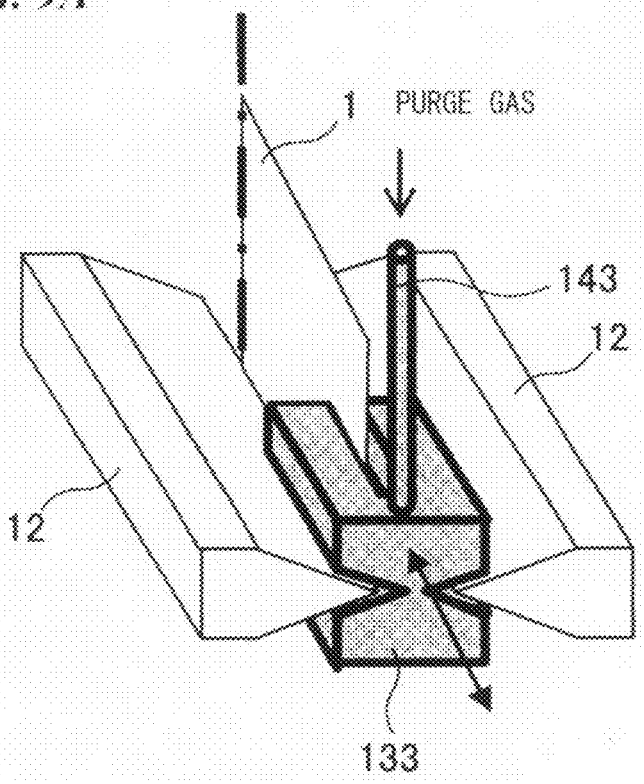
FIG. 9A is an explanatory diagram showing a configuration of the purge gas supply members and the seal boxes according to a third modified example of the embodiment.
Figure 9B:
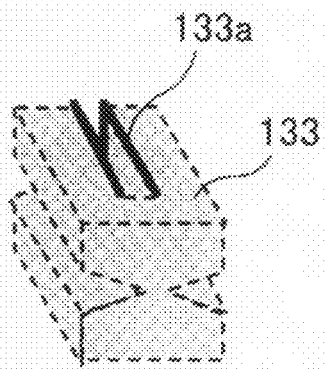
FIG. 9B is an explanatory diagram showing the gas sealing mechanism of the seal box according to the third modified example of the embodiment.

A third modified example of the first embodiment of the present invention shown in FIGS. 9A and 9B is an example in which two seal boxes 132 according to the second modified example are integrally combined with each other so as to cover the upper and lower portions of the gas wiping nozzle 12. Since a seal box 133 according to the modified example exists in both upper and lower portions of the gas wiping nozzles 12 as in the first modified example, it is possible to widen the region requiring the control of the oxygen concentration in the vicinity of the position where the wiping gas collides with the steel sheet 1. For this reason, it is possible to further improve the advantage of suppressing the formation of the whisper-shaped oxide films compared with the case of the first embodiment of the present invention. In addition, it is thought that the installation of the seal box 133 according to the modified example is easier than that of the seal box 131 according to the first modified example.

Since the structure of the seal box 133, a curtain seal nozzle 133*a*, a purge gas supply nozzle 143, and the like is the same as that of the case of the second modified example, the description thereof will be omitted.

Fourth Modified Example of First Embodiment

Figure 10A:
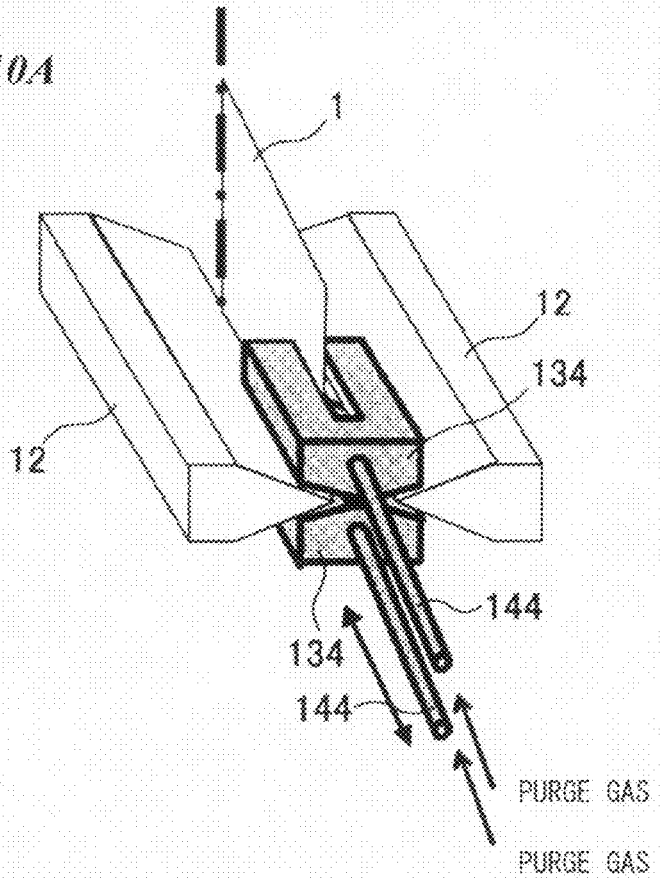
FIG. 10A is an explanatory diagram showing a configuration of the purge gas supply members and the seal boxes according to a fourth modified example of the embodiment.
Figure 10B:
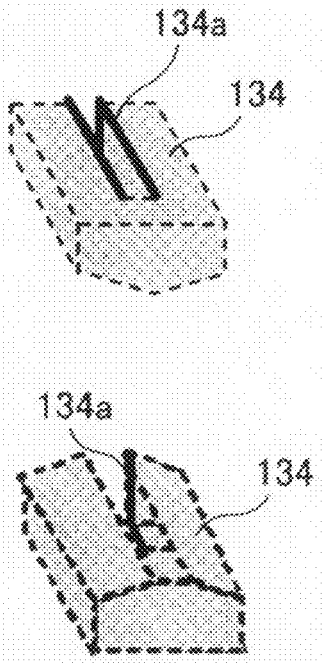
FIG. 10B is an explanatory diagram showing the gas sealing mechanism of the seal box according to the fourth modified example of the embodiment.

A fourth modified example of the first embodiment shown in FIGS. 10A and 10B is an example in which the seal box 132 according to the second modified example is provided in each of the upper and lower portions of the gas wiping nozzle 12. Since the structure and the function of the two seal boxes 134 according to the modified example are the same as those of the case of the second modified example, the description thereof will be omitted. As in the case of the first modified example, even in the modified example, the installation of the seal box 134 in the lower portion of the gas wiping nozzle 12 may be difficult.

In addition, the structure of the curtain seal nozzle 134*a* and the purge gas supply nozzle 144 according to the modified example is the same as that of the first embodiment.

Fifth Modified Example of First Embodiment

Figure 11A:
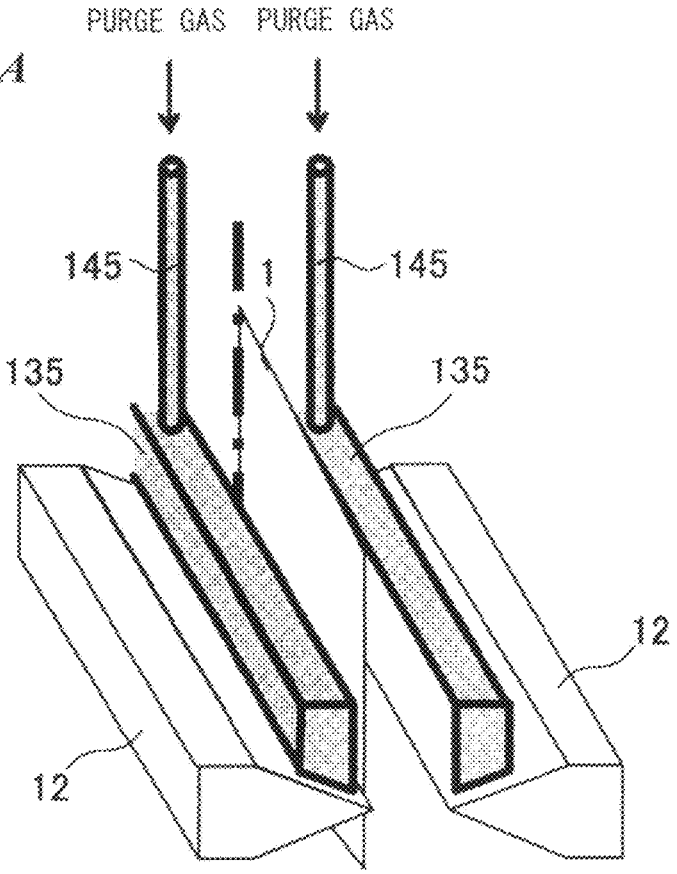
FIG. 11A is an explanatory diagram showing a configuration of the purge gas supply members and the seal boxes according to a fifth modified example of the embodiment.
Figure 11B:
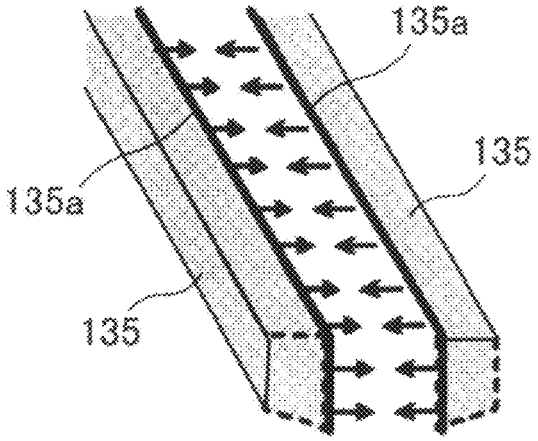
FIG. 11B is an explanatory diagram showing the gas sealing mechanism of the seal box according to the fifth modified example of the embodiment.

A fifth modified example of the first embodiment shown in FIGS. 11A and 11B is a modified example in which the length of the seal box in the sheet width direction is increased up to the size enabling the seal box to cover the entire width of the steel sheet. In the modified example, since it is not necessary to provide the seal box moving mechanism and it is possible to reduce the number of the driving facilities, it is possible to prevent troubles caused by an error in movement the seal box.

As shown in FIG. 11A, in the apparatus for the hot dip plating according to the modified example, the length of each seal box 135 in the sheet width direction of the steel sheet 1 is more than or equal to the length of the gas wiping nozzle 12 in the sheet width direction of the steel sheet 1. In general, the length of the gas wiping nozzle 12 in the sheet width direction of the steel sheet 1 is substantially the same as the sheet width of the steel sheet 1 or longer than the sheet width of the steel sheet 1. Accordingly, since the seal box 135 is provided in the upper portion of the gas wiping nozzle 12, the seal box 135 moves in accordance with the movement of the gas wiping nozzle 12. For this reason, according to the seal box 135 of the modified example, when the seal gas is injected from the nozzle 135*a* to the steel sheet 1 as shown in FIG. 11B, it is possible to always seal the entire width of the steel sheet 1 at the position where the wiping gas collides with the surface of the steel sheet 1 and the oxide films may be formed. For this reason, in the modified example, it is possible to obtain the particularly excellent advantage of suppressing the formation of the whisker-shaped oxide films. In addition, since the seal box 135 always seals the entire width of the steel sheet 1 at the position where the wiping gas collides with the surface of the steel sheet 1, it is not necessary to provide the seal box moving mechanism as in the first embodiment and the modified examples thereof. For this reason, it is possible to save the space of the apparatus for the hot dip plating, and to prevent the troubles caused by the movement error of the seal box 135. The description of the same configuration (a purge gas supply nozzle 145 and the like) as that of the first embodiment and the modified examples thereof will be omitted. Furthermore, in the modified example, the seal box may be divided so as to have a gap of 10 mm or more therebetween. In this case, it is necessary to provide the purge gas supply nozzle 145 in accordance with the number of divided seal boxes. However, it is possible to ensure that the collision position of the wiping gas is visually recognized.

Sixth Modified Example of First Embodiment

Figure 12A:
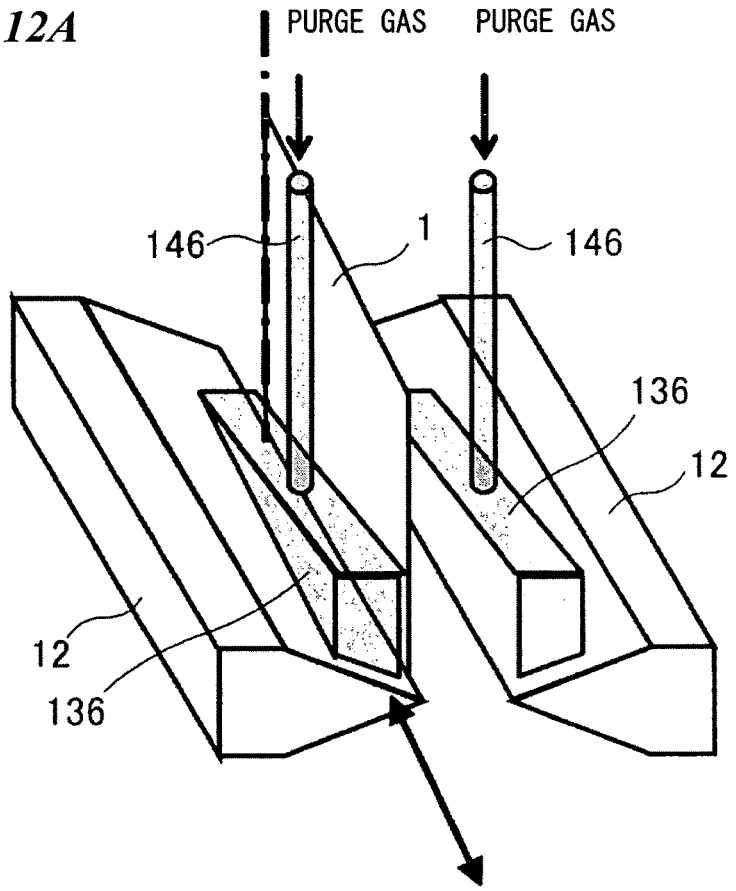
FIG. 12A is an explanatory diagram showing a configuration of the purge gas supply members and the seal boxes according to a sixth modified example of the embodiment.
Figure 12B:
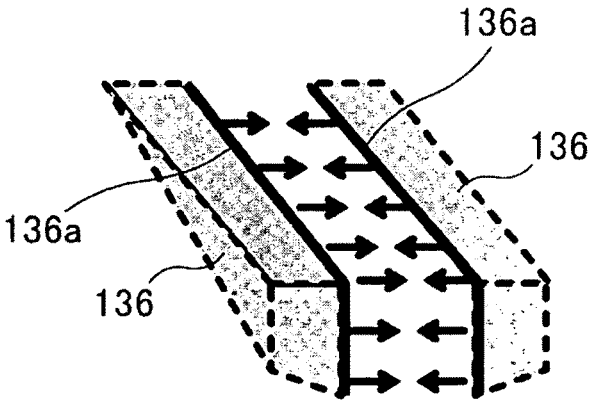
FIG. 12B is an explanatory diagram showing the gas sealing mechanism of the seal box according to the sixth modified example of the embodiment.

A modified example shown in FIGS. 12A and 12B is a modified example in which a shape of a nozzle 136*a* injecting the seal gas according to the first embodiment is formed in an L-shape. Here, the L-shape indicates a shape which is formed by two sides (two sides having the top, which is interposed between the two sides and located the farthest from the position where the wiping gas collides with the surface of the steel sheet 1) excluding a side, which is located the closest to the position where the wiping gas collides with the steel sheet 1 as shown in FIG. 12B, among three sides of a triangular opening of a seal box 136 facing the steel sheet 1. For this reason, the angle interposed between the two sides is not particularly limited. For example, in the case where the short side of the right triangular opening is disposed to be parallel to the steel sheet edge, an angle larger than 45° is interposed between two sides. In the modified example, it is preferable that the length (width) of the seal box 136 covering the gas wiping nozzle 12 in the sheet width direction of the steel sheet 1 be more than or equal to 200 mm and less than or equal to 400 mm. When the minimum width of the seal box 136 is not less than 200 mm, it is possible to perfectly cover the whisker-shaped oxide films. In addition, when the maximum width of the seal box 136 is not more than 400 mm, it is possible to obtain the satisfactory movement (moving operation) of the seal box 136 following the steel sheet edge. Furthermore, it is preferable that the range of length (height) of the seal box 136 in the vertical direction be more than or equal to 5 mm and less than or equal to 200 mm. When the maximum height of the seal box 136 is not more than 200 mm, it is possible to easily and visually recognize the collision position of the wiping gas during the operation, and thus to suppress the risk of the steel sheet 1 contacting the seal box 136. When the minimum height of the seal box 136 is not less than 5 mm, the minimum height is not less than the length (width) of the whisker-shaped oxide films in the sheet feeding direction, and thereby it is possible to perfectly cover the whisker-shaped oxide films.

In addition, it is preferable that a purge gas supply nozzle 146 blowing the purge gas be located in a direction (parallel to the steel sheet 1) perpendicular to the direction of the seal gas injection. This arrangement is to reduce the non-uniformity of the distribution of the seal gas injection.

When the L-shaped nozzle 136*a* is provided, it is possible to allow the amount of the seal gas colliding with the steel sheet 1 to be more uniform in the sheet width direction. Using the L-shaped nozzle 136*a*, it is possible to prevent troubles that the plating is scraped by the seal gas so as to be split and a difference in coating weight is generated. In the embodiment of the present invention, in order to use the L-shaped nozzle 136*a*, the seal box 136 having a simple triangular prism shape is used. However, in order to prevent a difference in coating weight in accordance with the flow of the fluid (the molten plating liquid and gas), the seal box 136 may have a shape in which an area covering the steel sheet becomes smaller in a direction from the steel sheet edge to the center of the sheet width direction of the steel sheet 1. In this case, the nozzle 136*a* injecting the gas is provided in the end (the bold line portion and the outline portion in FIG. 12B) of the opened surface on the side of the steel sheet 1. With such a structure, it is possible to prevent a difference in coating weight as in the L-shaped nozzle 136*a*.

(Apparatus for Hot Dip Plating According to Second Embodiment of the Present Invention)

Figure 13A:
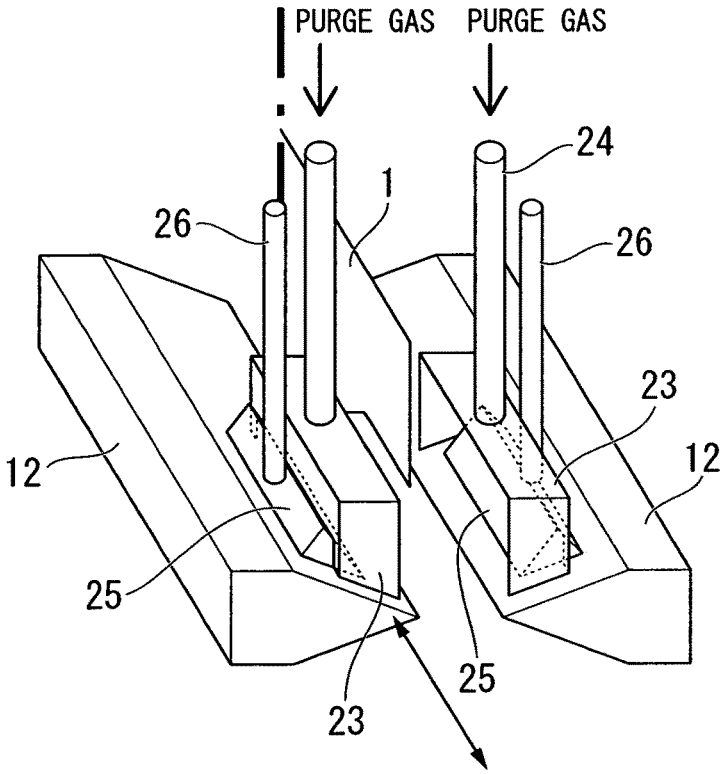
FIG. 13A is an explanatory diagram showing a configuration of the purge gas supply members and the seal boxes according to a second embodiment of the present invention.
Figure 13B:
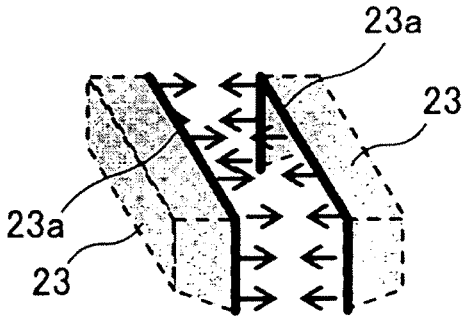
FIG. 13B is an explanatory diagram showing the gas sealing mechanism of the seal box according to the embodiment.

Next, the structure of the seal box, the purge gas supply nozzle, and the like in the apparatus for the hot dip plating according to a second embodiment of the present invention will be described with reference to FIGS. 13A and 13B. FIG. 13A is an explanatory diagram showing a configuration of a purge gas supply nozzle 24 as an example of the purge gas supply members and a seal box 23 according to the second embodiment of the present invention. FIG. 13B is an explanatory diagram showing the gas sealing mechanism of the seal box according to the second embodiment. The description of the same configuration as that of the first embodiment will be omitted.

As shown in FIG. 13A, in the apparatus for the hot dip plating according to the second embodiment of the present invention, the seal box 23 is provided so as to cover an assisting nozzle 25. The assisting nozzle 25 is disposed in the vicinity of the gas wiping nozzle 12. In the second embodiment of the present invention, the assisting nozzle 25 is disposed in the upper portion of the gas wiping nozzle 12, and a gas is supplied from a gas supply nozzle 26 for the assisting nozzle 25 so that the gas is injected to the steel sheet 1. Thus, the assisting nozzle 25 assists the gas injection of the wiping nozzle 12. Since the seal box 23 is disposed so as to cover the assisting nozzle 25, as shown in FIG. 13B, it is possible to supply a gas from the assisting nozzle 25 in addition to the curtain seal gas from the nozzle 23*a* disposed in the seal box 23. For this reason, in the second embodiment of the present invention, unlike the first embodiment, even the lower side (for example, a gap between the seal box 23 and the gas wiping nozzle 12) of the seal box 23 is sealed. Therefore, it is possible to further reliably seal the space including the edge of the steel sheet 1. Accordingly, since it is possible to further reliably suppress the inflow of the air from the outside (ambient atmosphere) of the seal box, it is possible to efficiently reduce the oxygen concentration inside the seal box 23 even when the supply amount of the purge gas from the purge gas supply nozzle 24 is reduced compared with the case of the first embodiment. In addition, as described above, it is easier to suppress the formation of the whisker-shaped oxide films of the end of the steel sheet which can be suppressed by the present invention as the coating weight of the steel sheet edge becomes smaller. For this reason, since it is possible to reduce the coating weight of the steel sheet edge by using the assisting nozzle, it is possible to obtain the advantage of more reliably suppressing the formation of the whisker-shaped oxide films.

First Modified Example of Second Embodiment

Figure 14A:
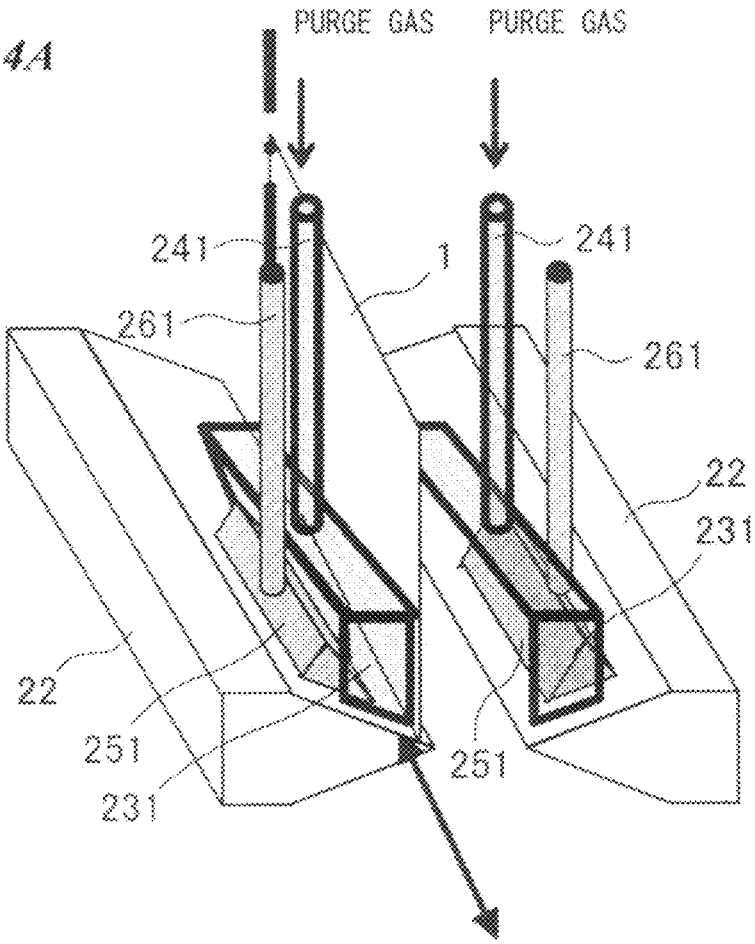
FIG. 14A is an explanatory diagram showing a configuration of the purge gas supply members and the seal boxes according to a first modified example of the embodiment.
Figure 14B:
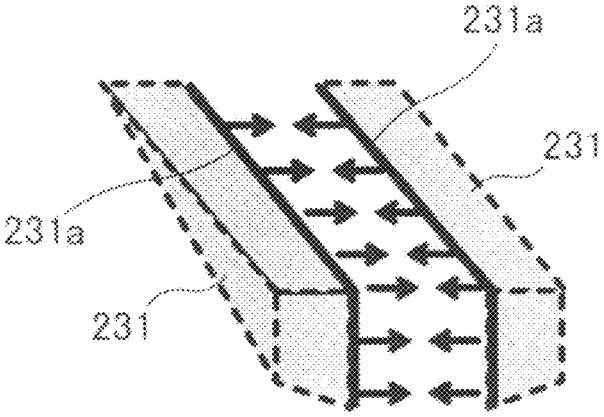
FIG. 14B is an explanatory diagram showing the gas sealing mechanism of the seal box according to the first modified example of the embodiment.

A modified example shown in FIGS. 14A and 14B is a modified example in which a nozzle 231*a* injecting a seal gas according to the second embodiment is formed in an L-shape. Here, the L-shape indicates a shape which is formed by two sides (two sides having the top, which is interposed between the two sides and located the farthest from the position where the wiping gas collides with the surface of the steel sheet 1) excluding a side, which is located the closest to the position where the wiping gas collides with the steel sheet 1, among three sides of a triangular opening of a seal box 231 facing the steel sheet 1 as shown in FIG. 14B. For this reason, the angle interposed between the two sides is not particularly limited. For example, in the case where the short side of the right triangular opening is disposed to be parallel to the steel sheet edge, an angle larger than 45° is interposed between two sides. In the modified example, it is preferable that the length (width) of the seal box 231 covering the gas wiping nozzle 22 in the sheet width direction of the steel sheet 1 is more than or equal to 50 mm and less than or equal to 400 mm. When the minimum width of the seal box 231 is not less than 50 mm, it is possible to perfectly cover the whisker-shaped oxide films. In addition, when the maximum width of the seal box 231 is not more than 400 mm, it is possible to obtain the satisfactory movement (moving operation) of the seal box 231 following the steel sheet edge, and thus to accommodate an assisting nozzle 251 in the practical application. Furthermore, it is preferable that the range of length (height) of the seal box 231 in the vertical direction be more than or equal to 5 mm and less than or equal to 200 mm. When the maximum height of the seal box 231 is not more than 200 mm, it is possible to easily and visually recognize the collision position of the wiping gas during the operation, and thus to suppress the risk of the steel sheet 1 contacting the seal box 231. When the minimum height of the seal box 231 is not less than 5 mm, the minimum height is not less than the length (width) of the whisker-shaped oxide films in the sheet feeding direction, and thereby it is possible to perfectly cover the whisker-shaped oxide films.

In addition, it is preferable that a purge gas supply nozzle 241 blowing the purge gas be located in a direction (parallel to the steel sheet 1) perpendicular to the direction of the seal gas injection. This arrangement is to reduce the non-uniformity of the distribution of the seal gas injection.

When the L-shaped nozzle 231*a* is provided, it is possible to allow the amount of the seal gas colliding with the steel sheet 1 to be more uniform in the sheet width direction. Using the L-shaped nozzle 231*a*, it is possible to prevent troubles that the plating is scraped by the seal gas so as to be split and a difference in coating weight is generated. In the example of the present invention, in order to use the L-shaped nozzle 231*a*, the seal box 231 having a simple triangular prism shape is used. However, in order to prevent a difference in coating weight in accordance with the flow of the fluid (the molten plating liquid and gas), the seal box 231 may have a shape in which an area covering the steel sheet becomes smaller in a direction from the steel sheet edge to the center of the sheet width direction of the steel sheet 1. In this case, the nozzle 231*a* injecting the gas is provided in the end (the bold line portion and the outline portion in FIG. 14B) of the opened surface on the side of the steel sheet 1. With such a structure, it is possible to prevent a difference in coating weight, as in the L-shaped nozzle 231*a*.

Hereinafter, the present invention will be described in more detail on the basis of the example.

Figure 15:
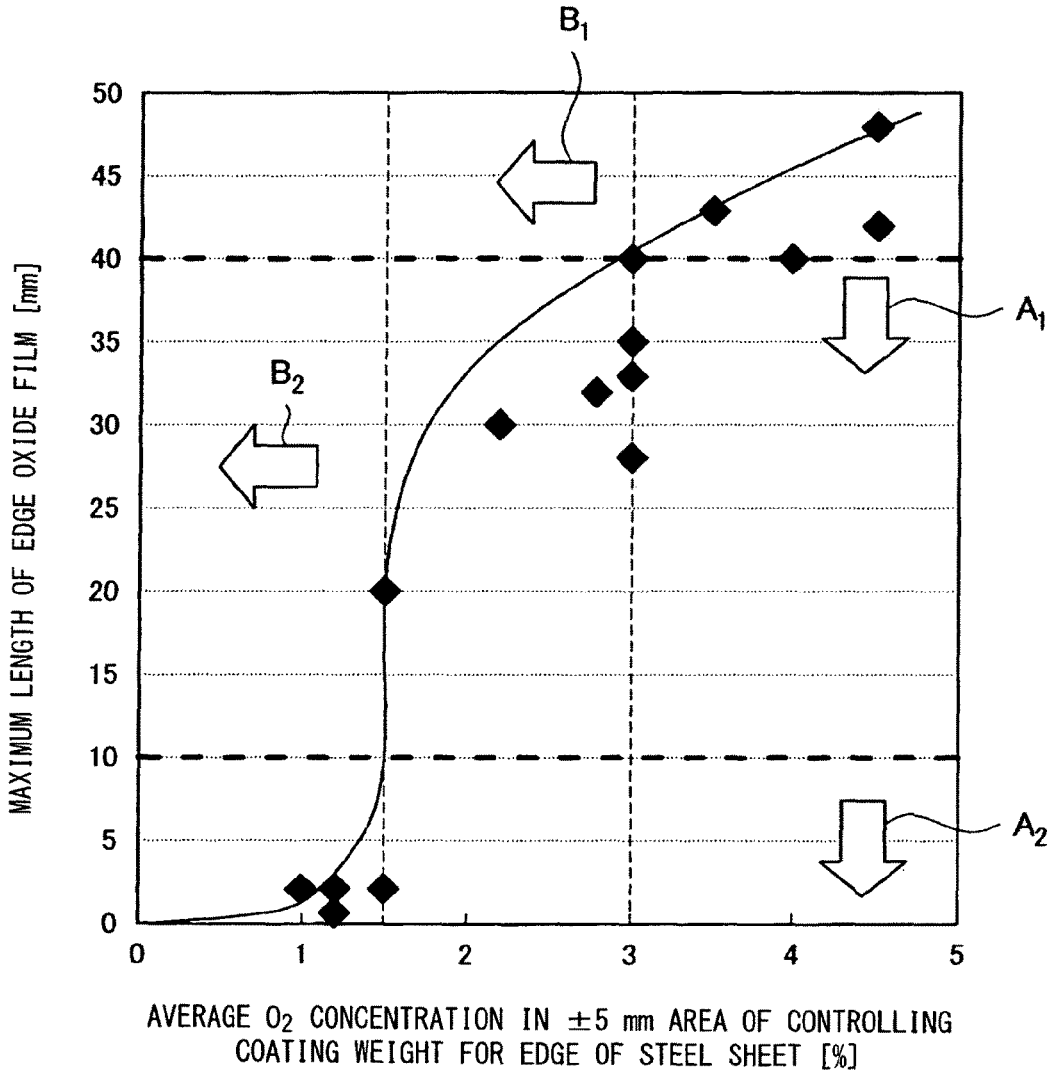
FIG. 15 is a graph showing a relationship between a maximum length of whisker-shaped oxide films and an average oxygen concentration of the steel sheet edge according to the example of the present invention.

In the example, the hot dip Zn-based plating is applied to the steel sheet continuously moving under the condition shown in TABLE 1 by using the apparatus for the hot dip plating shown in FIG. 13, and then the coating weight of one surface of the steel sheet pulled up from the plating bath is controlled to be 150 g/m$^2$ by using the gas wiping nozzle. While the coating weight is controlled, the maximum length of the whisker-shaped oxide films formed in the steel sheet edge and the average oxygen concentration in the range of ±5 mm (±5 mm in the upper and lower direction) of the collision position of the wiping gas in the steel sheet edge were measured. The average oxygen concentration was obtained in such a manner that the range of ±5 mm of the collision position of the wiping gas with respect to the steel sheet edge was measured every 2 mm (with 2 mm pitch), and the measurement values were averaged. In order to improve the precision in the oxygen concentration measurement, a Shizmadzu portable oxygen analyzer (POT-101) produced by Shimadzu corporation was used for the measurement of a low oxygen concentration, and a portable ppm oxygen analyzer (GPR-12) produced by Advanced Instruments Inc. was used for the measurement of a high oxygen concentration. Here, the low oxygen concentration is 1 ppm to 1 vol % (10,000 ppm), and the high oxygen concentration is 0.5 to 21 vol % (corresponding to the ambient atmosphere). In addition, in the case of measuring the oxygen concentration more than or equal to 0.5 and less than or equal to 1 vol %, the both oxygen analyzers were used in order to improve the precision. TABLE 2 shows the results. Furthermore, FIG. 15 shows the relationship between the average oxygen concentration and the maximum length of the oxide films shown in TABLE 2. In the example, it is sufficient for the length of the seal box on the downstream side in the sheet feeding direction to be set to 200 mm at maximum, and the length may be shorter than 200 mm.

TABLE 1

| | |
|---|---|
| Plating Type | Zn-based plating containing 11% of Al and 3% of Mg |
| Sheet Feeding Speed | 40 m/min |
| Controlled Coating Weight | 150 g/m$^2$ (one surface), 300 g/m$^2$ (both surfaces) |
| Sheet Thickness | 0.8 mm |
| Supply Gas of Wiping Nozzle | $N_2$ ($O_2$ concentration of 5 ppm or less) |
| Supply Gas of Assisting Nozzle | $N_2$ ($O_2$ concentration of 5 ppm or less) |
| Supply Gas into Seal Box | $N_2$($O_2$ concentration of 5 ppm or less) |

TABLE 2

| | Wiping Nozzle Pressure kg/cm$^2$ | Wiping Nozzle Gap* mm | Assisting Nozzle Pressure kg/cm$^2$ | Existence of Seal Box — | $O_2$ Concentration % | Maximum Whisker Length mm | |
|---|---|---|---|---|---|---|---|
| 1 | 0.06 | 10/10 | 0 | Yes | 3 | 35 | Example |
| 2 | 0.06 | 10/10 | 0.1 | Yes | 1.5 | 20 | Example |
| 3 | 0.06 | 10/10 | 0.3 | Yes | 1 | 2 | Example |
| 4 | 0.06 | 10/10 | 0.5 | Yes | 1.2 | 0.5 | Example |
| 5 | 0.06 | 10/10 | 0 | No | 4.5 | 42 | Comparative Example |
| 6 | 0.06 | 10/10 | 0.1 | No | 3 | 33 | Comparative Example |
| 7 | 0.06 | 10/10 | 0.3 | No | 3 | 40 | Comparative Example |
| 8 | 0.06 | 10/10 | 0.5 | No | 3.5 | 43 | Comparative Example |
| 9 | 0.08 | 15/15 | 0 | Yes | 2.8 | 32 | Example |
| 10 | 0.08 | 15/15 | 0.1 | Yes | 2.2 | 30 | Example |
| 11 | 0.08 | 15/15 | 0.3 | Yes | 1.2 | 2 | Example |
| 12 | 0.08 | 15/15 | 0.5 | Yes | 1.5 | 2 | Example |
| 13 | 0.08 | 15/15 | 0 | No | 4.5 | 48 | Comparative Example |
| 14 | 0.08 | 15/15 | 0.1 | No | 3 | 40 | Comparative Example |
| 15 | 0.08 | 15/15 | 0.3 | No | 3 | 28 | Comparative Example |
| 16 | 0.08 | 15/15 | 0.5 | No | 4 | 40 | Comparative Example |

*Wiping Nozzle Gas Is Expressed As Below.

Distance from Front Surface (Outside of Pot) of Wiping Nozzle to Surface of Steel Sheet/Distance from Rear Surface (Pot Side) of Wiping Nozzle to Surface of Steel Sheet As shown in TABLE 2, it was observed that the maximum length of the whisker-shaped oxide films in the examples in which the seal box according to the present invention was provided and the oxygen concentration was in the range of the present invention was remarkably smaller than that of the comparative examples in which the seal box was not provided and the oxygen concentration was not in the range of the present invention.

As shown in FIG. 15, the standard curve (the curve shown in FIG. 15) was obtained by plotting the data in TABLE 2. As a result, in the range of ±5 mm of the collision position of the wiping gas with respect to the steel sheet edge, the average oxygen concentration was not more than 3 vol % (see the arrow $B_1$ in FIG. 15), and the maximum length of the whisker-shaped oxide films was not more than 40 mm (see the arrow $A_1$ in FIG. 15). In addition, in the average oxygen concentration of 1.5 vol % or less (see the arrow $B_2$ in FIG. 15), the maximum length of the whisker-shaped oxide films was abruptly decreased to 40 mm or less (see the arrow $A_2$ in FIG. 15). From the result, it was proved that the formation of the whisker-shaped oxide films was suppressed when the oxygen concentration inside the seal box was not more than 3 vol % and the formation of the whisker-shaped oxide films was remarkably suppressed when the oxygen concentration was not more than 1.5 vol %.

While the preferred embodiments of the present invention are described above with reference to the accompanying drawings, the present invention is not limited to the examples. It is obvious to those skilled in the art that various changes and modifications can be made in a category described in claims, without departing from the technical scope of the present invention.

In the method for producing the hot dip plated steel sheet and the apparatus for the hot dip plating used in the method, when the coating weight is controlled, the formation of the oxide films on the surface of the plated steel sheet is suppressed and the inconvenience in operation is eliminated.

BRIEF DESCRIPTION OF THE REFERENCE SYMBOLS

1 Steel sheet
5 Plating metal
10 Apparatus for hot dip plating
11 Plating bath
12 Gas wiping nozzle
13, 23, 131, 132, 133, 134, 135, 136, 231 Seal box
14, 24, 141, 142, 143, 144, 145, 146, 241 Purge gas supply nozzle
16 Snout
17 Bath roll
51 Driving motor
53 Screw shaft
55 Steel sheet edge detecting sensor

What is claimed is:

1. A method for producing a hot dip plated steel sheet, the method comprising:

continuously immersing a steel sheet in a plating bath;

pulling up the steel sheet having a plating metal adhered on a surface of the steel sheet from the plating bath;

controlling a coating weight of the plating metal on the surface of the steel sheet with a wiping gas injected through a gas wiping nozzle toward two surfaces of the steel sheet from when the steel sheet is pulled up from the plating bath to when the plating metal adhered on the surface of the steel sheet is solidified; and shielding two edges of the steel sheet at a position where the wiping gas collides with the steel sheet pulled up from the plating bath, by using a seal box, wherein a surface of the plating bath is exposed to an air atmosphere so that the surface of the plating bath is covered with an oxide film, wherein the seal box includes an opening facing the two surfaces of the steel sheet, a gas injection member configured to inject a seal gas toward the two surfaces of the steel sheet, and provided along all of a periphery of the opening, and a purge gas supply member configured to introduce an inert gas into the seal box in which the inert gas contains 0.05 vol % to no more than 3 vol % of oxygen, wherein the seal gas forms a gas curtain which acts as a barrier blocking ambient atmosphere so that the seal box and the gas curtain define a space which is insulated from the ambient atmosphere and in which an oxygen concentration is controlled by the inert gas to at least 0.05 vol % to no more than 3 vol % when the wiping as is injected toward the two surfaces of the steel sheet, wherein the space includes a region, which is from the edges of the two surfaces of the steel sheet to 50 mm or more in the sheet width direction towards a center of the steel sheet and at which the gas collides with the steel sheet, and excludes the surface of the plating bath, wherein the seal box is disposed on the gas wiping nozzle, and wherein the gas wiping nozzle is configured to move so that a distance between the periphery of the opening of the seal box and the two surfaces of the steel sheet is controlled within a range of 3 to 200 mm.

2. The method for producing the hot dip plated steel sheet according to claim 1, wherein the oxygen concentration in the space including two edges of the two surfaces of the steel sheet is at least 0.05 vol % to no more than 1.5 vol %.

3. The method for producing the hot dip plated steel sheet according to claim 1 or 2, wherein the region included in the space is from where the gas collides with the steel sheet to at least 5 mm on the downstream side in a sheet feeding direction of the steel sheet, and wherein the region is from the edges of the two surfaces of the steel sheet to at least 50 mm to no more than 400 mm in the sheet width direction towards the center of the steel sheet.

4. The method for producing the hot dip plated steel sheet according to claim 1 or 2, further comprising providing a plurality of spaces in the sheet width direction of the steel sheet, wherein a width of a gap between adjacent spaces is at least 10 mm and the gap is excluded by the seal box.

5. The method for producing the hot dip plated steel sheet according to claim 1 or 2, wherein a width in the sheet feeding direction of an area of the two surfaces of the steel sheet included in the space becomes smaller from the two edges of the steel sheet to the center in the sheet width direction of the steel sheet.

6. The method for producing the hot dip plated steel sheet according to claim 1 or 2, wherein the coating weight on the surface of the steel sheet from the two edges of the steel sheet to 10 mm in the sheet width direction is at least 50 $g/m^2$ to no more than 380 $g/m^2$.

7. The method for producing the hot dip plated steel sheet according to claim 1 or 2, wherein the plating bath contains at least one of Zn, Al, Mg, Si, Sr, Cr, Sn, or Ca.

8. The method for producing the hot dip plated steel sheet according to claim 1 or 2, wherein the plating bath is Zn-based comprising at least 0.1 mass % to no more than 60 mass % Al and at least 0.2 mass % to no more than 5 mass % Mg.

9. The method for producing the hot dip plated steel sheet according to claim 1 or 2, wherein the method is carried out using an apparatus for hot dip plating, the apparatus comprising:

the plating bath into which the steel sheet moving through a production line is continuously immersed;

the gas wiping nozzle configured to inject the wiping gas toward the surface of the steel sheet pulled up from the plating bath;

the seal box spaced from the surface of the plating bath, and covering the space at the two edges of the two surfaces of the steel sheet where the gas collides with the steel sheet pulled up from the plating bath; and the purge gas supply member configured to introduce the inert gas into the seal box, thereby controlling an oxygen concentration inside the space defined by the seal box and the gas curtain.

10. The method for producing the hot dip plated steel sheet according to claim 9, wherein the purge gas supply member is configured to control the oxygen concentration inside the space to at least 0.05 vol % to no more than 3 vol %.

11. The method for producing the hot dip plated steel sheet according to claim 9, wherein the purge gas supply member is configured to control the oxygen concentration inside the space to at least 0.05 vol % to no more than 1.5 vol %.

12. The method for producing the hot dip plated steel sheet according to claim 9, wherein the apparatus for hot dip plating further comprises at least a pair of the seal boxes facing each other with the steel sheet interposed therebetween, and configured to inject the seal gas toward the two surfaces of the steel sheet thereby sealing the space between the seal boxes facing each other by the gas curtain.

13. The method for producing the hot dip plated steel sheet according to claim 9, wherein the seal box is configured to cover an assisting nozzle for assisting the gas injection of the wiping nozzle in the vicinity of the wiping nozzle.

14. The method for producing the hot dip plated steel sheet according to claim 9, wherein the apparatus for hot dip plating further comprises a seal box moving mechanism which moves the seal box in the sheet width direction in accordance with the sheet width of the steel sheet.

15. The method for producing the hot dip plated steel sheet according to claim 9, wherein the seal box covers the space including the region from where the gas collides with the steel sheet to at least 5 mm on the downstream side in the sheet feeding direction of the steel sheet, and the region is from the two edges of the two surfaces of the steel sheet to at least 50 mm to no more than 400 mm in the sheet width direction of the steel sheet towards a center of the steel sheet.

16. The method for producing the hot dip plated steel sheet according to claim 9, wherein the apparatus for hot dip plating further comprises a plurality of the seal boxes in the sheet width direction of the steel sheet, and a gap between the adjacent seal boxes has a width of at least 10 mm.

17. The method for producing the hot dip plated steel sheet according to claim 9, wherein the seal box has a shape covering an area of the two surfaces of the steel sheet, of which a width in the sheet feeding direction becomes smaller in a direction from the edge of the steel sheet to the center in the sheet width direction of the steel sheet.

18. The method for producing the hot dip plated steel sheet according to claim 9, wherein the seal box has a length in the sheet width direction of the steel sheet of at least a sheet width of the steel sheet.

19. The method for producing the hot dip plated steel sheet according to claim 9, wherein the seal box comprises the gas injection member configured to inject the seal gas toward the two surfaces of the steel sheet, and the gas injection member is formed in an L-shape.

* * * * *